US005968706A

United States Patent [19]

Yamashita et al.

[11] Patent Number: 5,968,706

[45] Date of Patent: Oct. 19, 1999

[54] SILVER HALIDE PHOTOGRAPHIC MATERIAL AND IMAGE FORMATION METHOD USING THE SAME

[75] Inventors: Seiji Yamashita; Toshiki Fujiwara; Toru Harada, all of Kanagawa, Japan

[73] Assignee: Fuji Photo Co., Ltd., Kanagawa, Japan

[21] Appl. No.: 08/807,892

[22] Filed: Feb. 26, 1997

[30] Foreign Application Priority Data

Feb. 26, 1996 [JP] Japan ..... 8-061613

[51] Int. Cl.[6] ..... G03C 5/29

[52] U.S. Cl. ..... 430/139; 430/440; 430/446

[58] Field of Search ..... 430/139, 436, 430/440, 446

[56] References Cited

U.S. PATENT DOCUMENTS

| | | | |
|---|---|---|---|
| 4,933,268 | 6/1990 | Ohno et al. | 430/518 |
| 5,422,220 | 6/1995 | Leblans et al. | 430/139 |
| 5,460,916 | 10/1995 | Iwasaki | 430/139 |
| 5,482,813 | 1/1996 | Tadashi | 430/139 |
| 5,503,965 | 4/1996 | Okutsu | 430/440 |
| 5,576,160 | 11/1996 | Goan et al. | 430/139 |
| 5,618,661 | 4/1997 | Sampei | 430/440 |

FOREIGN PATENT DOCUMENTS

| | | | |
|---|---|---|---|
| 58-111938 | 7/1983 | Japan | G03C 1/485 |
| 1-126645 | 5/1989 | Japan | G03C 1/84 |
| 1-172828 | 7/1989 | Japan | G03C 1/00 |

*Primary Examiner*—Hoa Van Le

*Attorney, Agent, or Firm*—Sughrue, Mion, Zinn, Macpeak & Seas, PLLC

[57] ABSTRACT

A silver halide photographic material enabling very rapid processing and extremely low waste liquid processing, which comprises a transparent film support having provided on each side thereof at least one light-sensitive silver halide emulsion layer and a dye-fixed layer for absorbing the crossover light disposed nearer to the support, wherein a dye used in said dye-fixed layer is a compound which is decolorized in development processing.

3 Claims, No Drawings

SILVER HALIDE PHOTOGRAPHIC MATERIAL AND IMAGE FORMATION METHOD USING THE SAME

FIELD OF THE INVENTION

The present invention relates to a silver halide photographic material, and particularly to an image formation system in which a black-and-white silver halide photographic material for radiographic image use is developed with an automatic processor.

BACKGROUND OF THE INVENTION

Various attempts have hitherto been made to make rapid and low-replenishing processing compatible with the high quality of X-ray images for medical use.

For example, JP-B-1-126645 (the term "JP-B" as used herein means an "examined Japanese patent publication") discloses a technique of providing a crossover cut layer which is mordanted with a dye, between an emulsion layer and a support to make image sharpness compatible with rapid processing.

Further, JP-A-1-172828 (the term "JP-A" as used herein means an "unexamined published Japanese patent application") discloses a technique of using a solid-dispersed decolorization type dye in a crossover cut layer for the compatibility between high image sharpness and rapid processing in which the total development processing time is less than 90 seconds and the crossover light is 10% or less.

Furthermore, JP-A-58-111938 discloses that high absorption caused by a spectral sensitizing dye allowed to be adsorbed by tabular grains high in specific surface area decreases the crossover light, and that the use of a dye low in molecular weight, high in water solubility and good in decolorization as the spectral sensitizing dye enables realization of high image quality and rapid processing.

However, these techniques have not established the compatibility of rapid processing with minimized replenishment and waste liquid of processing solutions, and formation of such high-quality images as do not substantially have the crossover light.

The conventional techniques, in which dyes or coloring matter allowed to be adsorbed by emulsions used in the crossover cut layers are quickly eluted from photographic materials in development-fixing-washing processing, thereby removing the dyes or the coloring matter so as not to remain in the photographic materials to cause no influence of contamination due to the dyes or the coloring matter on the photographic materials after the processing, have the problem that as the replenishment rate and the amount of the waste liquid of the processing solutions decrease, the dyes or the coloring matter is accumulated in the processing solutions themselves, resulting in contamination of the photographic materials, or deposited on rolls or conveying systems of the photographic materials of automatic processors to contaminate the automatic processors, or transferred to the photographic materials to contaminate the photographic materials. In these conventional techniques, the diffusibility of the dyes or the coloring matter comes into question for decolorization. Accordingly, these techniques have a limitation as a matter of course also from the viewpoint of rapid processing.

SUMMARY OF THE INVENTION

An object of the present invention is to provide an X-ray image formation system for medical use securing high sharpness even in a very rapid processing system in which the whole development processing time with an automatic processor is less than 80 seconds, and enabling such extremely low replenishment and waste liquid processing that both or either of the replenishment rate and the amount of the waste liquid of developing and fixing solutions is 300 ml or less, and to provide a silver halide photographic material suitable therefor.

Another object of the present invention is to provide an X-ray image formation system for medical use easy in maintenance which requires very few frequencies of washing of an automatic processor, replenishment and waste liquid control, and mother liquor exchange, even when a photographic material is processed in such large amounts as more than 20 $m^2$/day, and to provide a silver halide photographic material suitable therefor.

Still another object of the present invention is to provide a black-and-white silver halide photographic material for radiographic image formation for medical use which has the above-mentioned features of the processing system and can reduce blurs of an image caused by the crossover light to provide very high image quality in combination with a screen high in luminance.

As a result of intensive investigation, the present inventors have discovered that these and other objects of the present invention can be attained by the following photographic materials and image formation methods:

(1) A silver halide photographic material comprising a transparent film support having provided on each surface thereof at least one light-sensitive silver halide emulsion layer and a dye-fixed layer for absorbing the crossover light disposed nearer to the support than said at least one-sensitive silver halide emulsion layer, wherein a dye used in said dye-fixed layer is a compound which is decolorized in development processing.

(2) The silver halide photographic material described in (1), wherein said dye is a compound which is decolorized at a pH of 8 or more.

(3) The silver halide photographic material described in (1), wherein said dye is a compound which is decolorized at a pH of 5.5 or less.

(4) The silver halide photographic material described in (1), wherein said dye is a compound which is decolorized by light irradiation of 100,000 lux·min. or less.

(5) The silver halide photographic material described in any one of (1) to (4), wherein said light-sensitive silver halide emulsion layer contains a silver halide grain emulsion having a silver chloride content of 20% or more and an average aspect ratio of 2 or more.

(6) The silver halide photographic material described in any one of (1) to (5), wherein said photographic material is developed with a developing solution containing ascorbic acid and/or a derivative thereof as a developing agent.

(7) An image formation method using the silver halide photographic material described in any one of (1) to (6), wherein the total development processing time (dry to dry) is 80 seconds or less, and 10% or more of the decolorization dye remains in the photographic material after development.

(8) An image formation method using the silver halide photographic material described in any one of (1) to (7), wherein the crossover light is 30% or less, and the amount of waste liquid of a developing solution and/or a fixing solution is 300 ml or less per $m^2$ of the photographic material.

(9) An image formation method using the silver halide photographic material described in any one of (1) to (8), wherein an X-ray image is formed in combination with a phosphor having a luminescence maximum at 500 nm to 700 nm.

DETAILED DESCRIPTION OF THE INVENTION

The present invention will be described in detail below.

The term "development processing" as used in this invention means a process comprising development, fixing, washing and drying. Further, the term "total development processing time" as used in this invention means the total of times (dry to dry) required for processing basically including respective steps of the development, fixing, washing and drying. Each step may further comprise two or more stages if necessary. The washing step may be a rinsing step or a stabilizing step. Further, stabilizing bath steps and/or washing steps may intervene between these steps. For example, double fixing tanks can extremely reduce the silver ion concentration of the second fixing tank, which causes the silver ion concentration of washing waste liquid to be markedly decreased.

This shows that a reduction in the silver ion concentration of the washing waste liquid can provide a processing system desirable for the environment. Further, two or more washing tanks can significantly decrease the replenishment of washing water and waste liquid. Accordingly, a complete recovery system of waste liquid including washing water, which is preferred for the environment, can be provided.

When a dye which is decolorized by light irradiation is used in the present invention, the development step further comprises a decolorizing step by light irradiation. This decolorizing step may coexist with the fixing step or later, or independently, for example, before or after the drying step. In the present invention, however, the total processing time does not contain the time required for this decolorizing step by light irradiation. The total processing time is preferably 5 seconds to 80 seconds, and more preferably 10 seconds to 60 seconds. Very rapid processing having a total processing time of 20 seconds to 50 seconds is most preferred.

The term "dye decolorization" as used in the present invention means that the absorption of the dye at 550 nm is decreased to 5% or less of that before processing.

In the present invention, the decolorization type dyes may remain in the photographic materials after processing at a rate of 10% or more, preferably at a rate of 20% to 100%, and more preferably at a rate of 30% to 100%. It is particularly preferred that the dyes remain at a rate of 50% to 100%. The remaining rate of the dyes can be quantitatively examined by analyzing samples before and after processing by use of liquid chromatography.

The crossover light of the photographic material of the present invention can be basically determined from the relationship between the front surface (on the side of a phosphor) sensitivity and the back surface sensitivity of the photographic material at the time when the photographic material comprising a support having provided on both surface thereof silver halide emulsion layers is exposed to X-rays placing the phosphor on one side thereof. In this evaluation method, the crossover light of the photographic material of the present invention is preferably 30% or less, more preferably 20% or less, and most preferably 8% or less. The lower limit thereof is 2%, because less than 2% leads to too much amount of the dye coated per unit area, which has harmful effects such as a brittle film of the photographic material.

In the present invention, both or either of the amounts of waste liquid of the developing solution and the fixing solution is preferably 0 ml to 300 ml, and particularly preferably 0 ml to 120 ml, when converted per $m^2$ of photographic material. When the amount of the developing waste liquid is 0 ml, coating development as described in JP-A-3-13939 and JP-A-3-41447 is preferably employed without using a normal developing bath.

In the present invention, multistage washing can be preferably used, wherein the washing waste liquid can be wholly or partially mixed with the fixing waste liquid. In this case, the amount of the washing waste liquid is preferably 0 ml to 600 ml, and more preferably 0 ml to 300 ml, per $m^2$ of photographic material.

In the present invention, the dyes which are decolorized at a pH of 8 or more are decolorized in the development step or the decolorizing step using an independent high-pH solution. These steps are included in the total processing process in -the present invention. The pH at which decolorization is conducted is preferably 8 to 13, and more preferably 9 to 12.5.

Examples of the dyes which are decolorized at a pH of 8 or more in the present invention are enumerated below, but the present invention is not limited thereto.

L-1

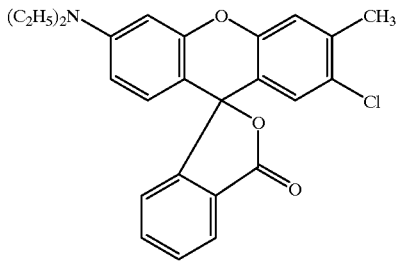

L-2

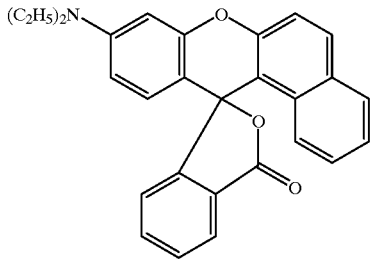

L-3

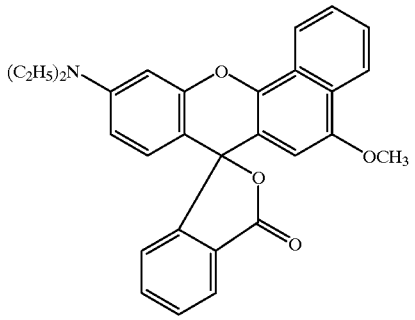

-continued

L-4

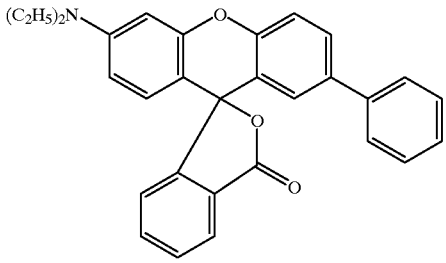

L-5

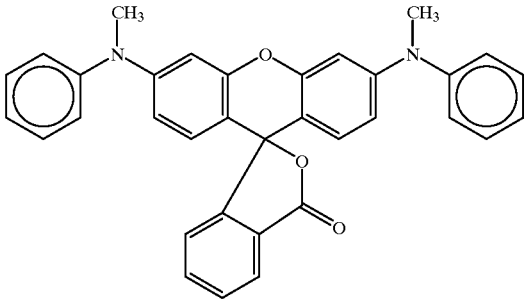

L-6

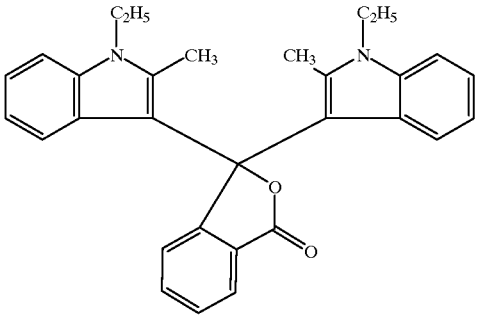

L-7

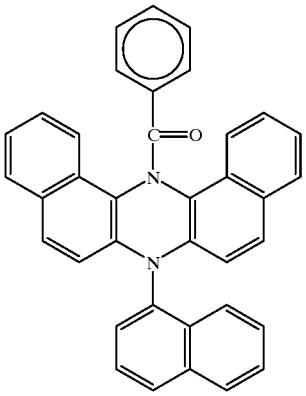

-continued

L-8

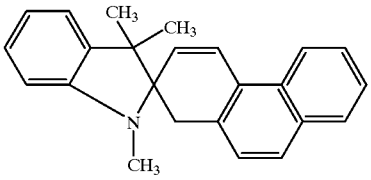

L-9

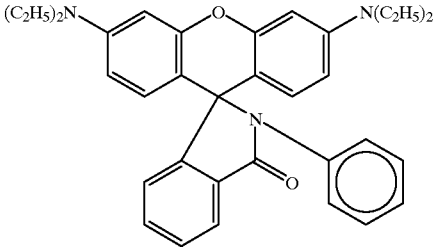

L-10

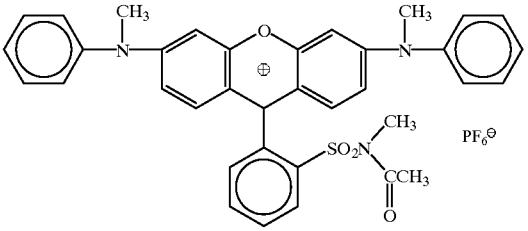

The decolorizing step of the dyes which are decolorized at a pH of 5 or less in the present invention is a fixing and washing step. The pH at which decolorization is conducted is preferably 1 to 5.5, and more preferably 3 to 5.0.

Examples of the dyes which are decolorized at a pH of 5.5 or less in the present invention are enumerated below, but the present invention is not limited thereto.

S-1
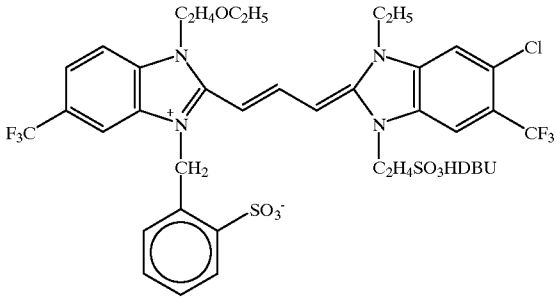
S-2
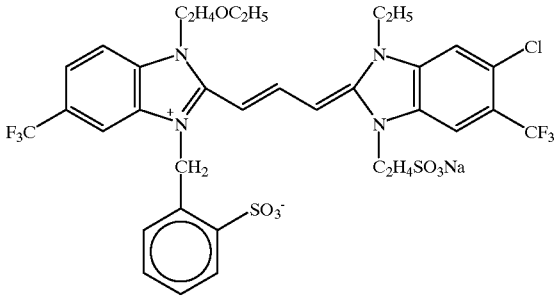
S-3
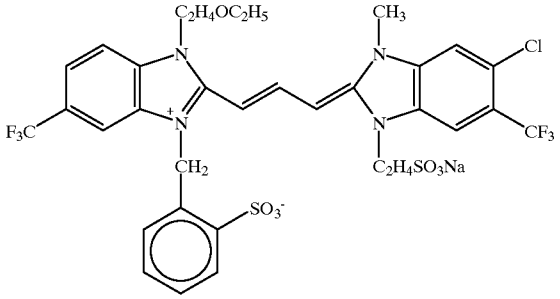
S-4
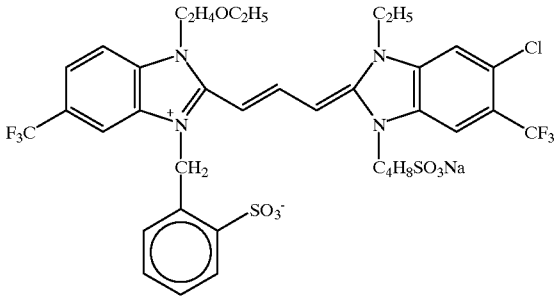

-continued
S-5
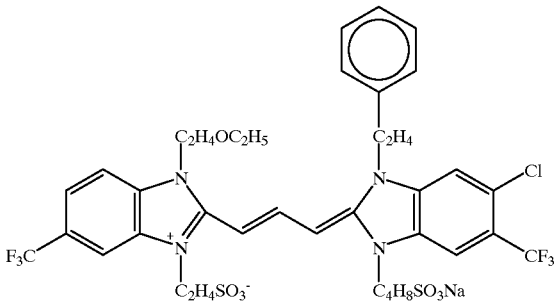
S-6
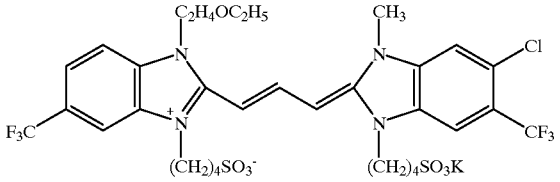
S-7
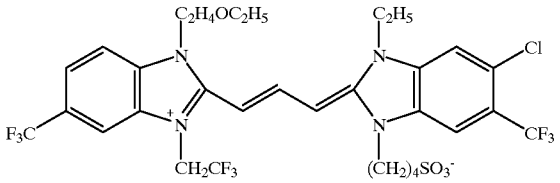
S-8
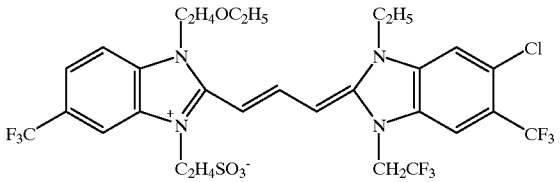
S-9
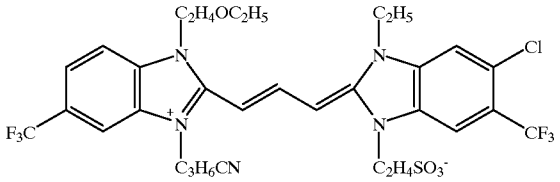
S-10
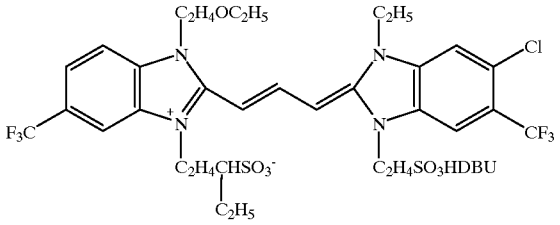

-continued
S-11
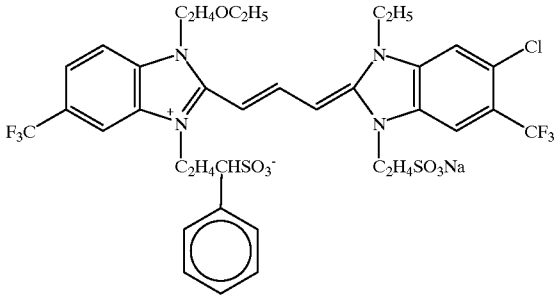
S-12
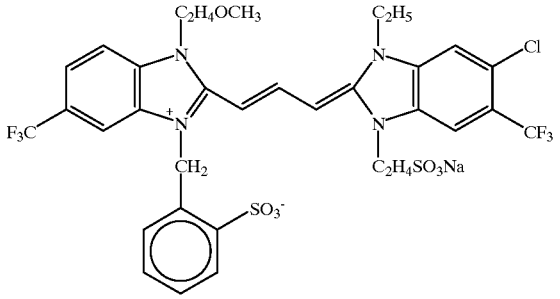
S-13
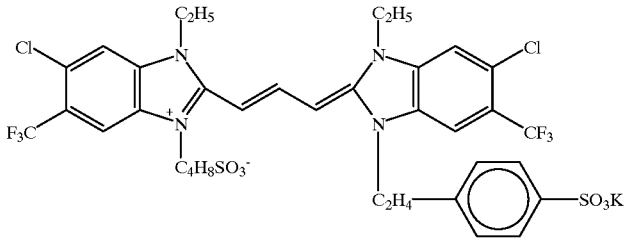
S-14
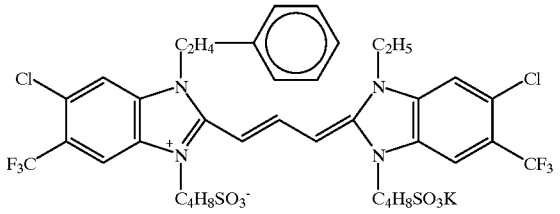
S-15
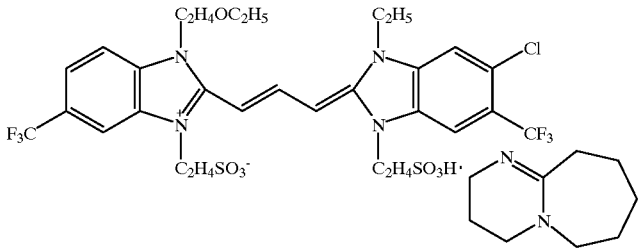

In order to convert these compounds to the color-developed state, the following compounds are preferably used as developers.
K-1
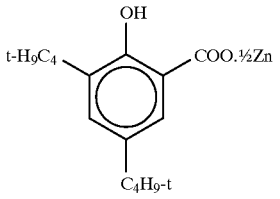
K-2
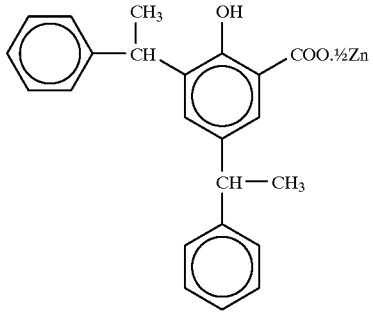
K-3
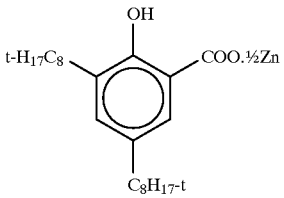
K-4
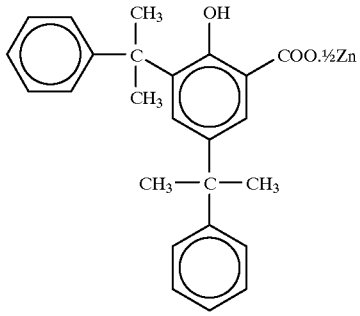
K-5
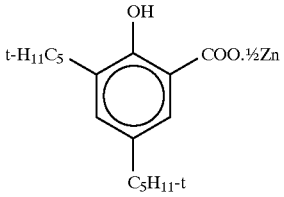
-continued
K-6
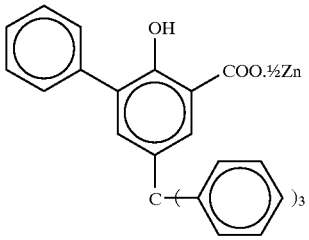
K-7
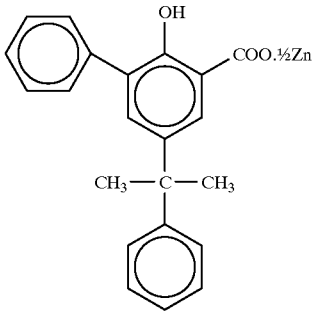
K-8
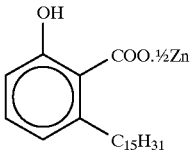
K-9
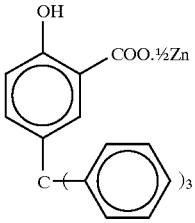
K-10
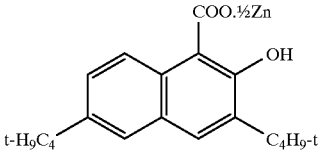
K-11
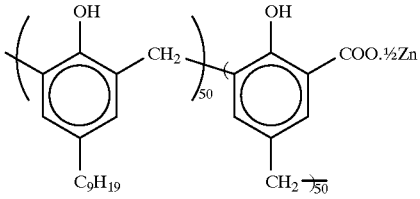

-continued

K-12

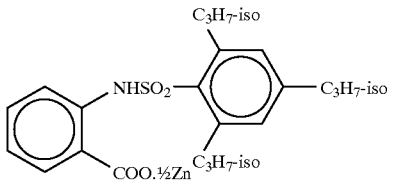

K-13

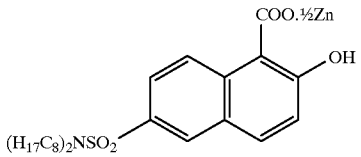

K-14

Zn Salt of

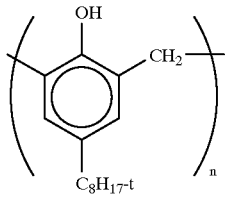

K-15

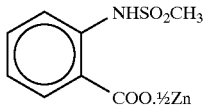

K-16

Zn Salt of

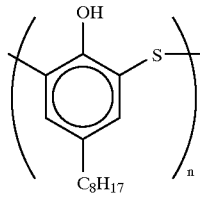

K-17

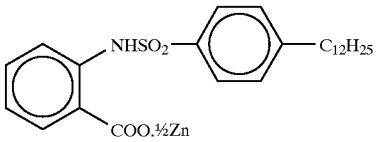

K-18

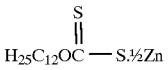

K-19

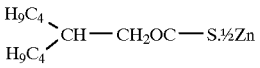

K-20

$Zn(SCN)_2$

K-21

Complex of Zn(SCN) and

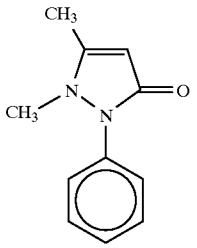

The dose of light at which the dyes decolorized by light irradiation in the present invention are decolorized is 100,000 lux·min. or less. The time required for decolorization is preferably 60 seconds or less, and more preferably 1 second to 50 seconds. Heating may be employed for acceleration of decolorization. The heating temperature is preferably 40° C. to 150° C., and more preferably 50° C. to 120° C. If the heating temperature is higher than 150° C., there is the danger of deforming, or expanding and contracting the supports formed of commonly used raw materials such as polyethylene terephthalate, polyethylene naphthalate and cellulose triacetate. The use of compounds not having such a trouble permits heating at a higher temperature.

The dyes which are decolorized by light in the present invention are shown below.

The examples of the compounds which are decolorized by light in the present invention include (i) compounds represented by general formula (1), and (ii) compounds represented by general formula (2) and general formula (3).

(1)

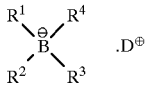

wherein $R^1$, $R^2$, $R^3$ and $R^4$ each represents an alkyl group, an aryl group, an allyl group, an aralkyl group, an alkenyl group, an alkynyl group, a silyl group or a heterocyclic group; and $D^+$ represents a cationic dye.

(2)

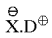

wherein $X^-$ represents an anion; and $D^+$ represents a cationic dye.

(3)

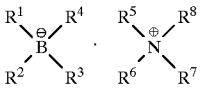

wherein $R^1$, $R^2$, $R^3$ and $R^4$ each represents an alkyl group, an aryl group, an allyl group, an aralkyl group, an alkenyl group, an alkynyl group, a silyl group or a heterocyclic group; and $R^5$, $R^6$, $R^7$ and $R^8$ each represents a hydrogen atom, an alkyl group, an aryl group, an allyl group, an aralkyl group, an alkenyl group, an alkynyl group or a heterocyclic group.

General formula (1) is described in detail. The alkyl groups represented by $R^1$ to $R^4$ preferably have 1 to 12 carbon atoms, and more preferably have 1 to 8 carbon atoms (for example, methyl, ethyl, propyl, butyl, hexyl and octyl). The aryl groups represented by $R^1$ to $R^4$ are preferably phenyl groups, which may be substituted by methyl groups, methoxy groups or halogen atoms (F, Cl and Br). The aralkyl groups represented by $R^1$ to $R^4$ include benzyl and phenylethyl. The alkenyl groups represented by $R^1$ to $R^4$ include alkenyl groups having 2 to 6 carbon atoms (e.g., 2-pentenyl, vinyl, 2-butenyl, 1-propenyl and 2-propenyl). The alkynyl groups represented by $R^1$ to $R^4$ include ethynyl and 2-propynyl. The heterocyclic groups represented by $R^1$ to $R^4$ include pyrrole, pyridine and pyrrolidine. The silyl groups represented by $R^1$ to $R^4$ are groups represented by $SiR^9R^{10}R^{11}$, wherein $R^9$, $R^{10}$ and $R^{11}$ are each alkyl groups (having the same meaning as given above) or aryl groups (having,the same meaning as given above). Preferred examples of-the groups represented by $R^1$ to $R^4$ include alkyl, aralkyl and aryl groups.

As the cationic dyes, various dyes can be used such as cyanine, Rhodamine, Methylene Blue and safranine dyes described in JP-A-62-150242, cyanine, polymethine and pyrylium dyes described in 5-188635, cyanine, azomethine, stilyl, xanthene and azine dyes described in JP-A-57-19734, cyanine, xanthene and stilyl dyes described in JP-A-64-13144, cyanine dyes described in JP-A-64-88444, triarylmethane dyes described in JP-A-7-150070, tetrazine and diimmonium dyes described in JP-A-4-146905 and xanthene, thioxanthene, oxazine, thiazine, cyanine, diphenylmethane, triphenylmethane and pyrylium dyes described in JP-A-5-59110.

Cyanine dyes represented by the following general formula (4) are preferred among others:

(4)

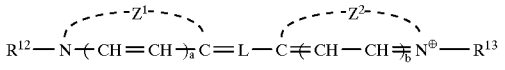

wherein $Z^1$ and $Z^2$ each represents a nonmetallic atom group necessary for formation of a 5- or 6-membered nitrogen-containing heterocycle which may be cyclocondensed; $R^{12}$ and $R^{13}$ each represents an alkyl group, an alkenyl group or an aralkyl group; L represents a connecting group formed by connecting 1, 3, 5, 7 or 9 methine groups with conjugated double bonds; and a and b each represents 0 or 1.

General formula (4) is described in detail. The 5- or 6-membered nitrogen-containing heterocycles represented by $Z^1$ and $Z^2$ which may be cyclocondensed include oxazole, isoxazole, benzoxazole, naphthoxazole, thiazole, benzothiazole, naphthothiazole, indolenine, benzoindolenine, imidazole, benzimidazole, naphthoimidazole, quinoline, pyridine, pyrrolopyridine, furopyrrole, indolizine and imidazoquinoxaline rings, and preferred examples thereof include 5-membered nitrogen-containing heterocycles formed by cyclocondensation of benzene rings or naphthalene rings. These heterocycles may be substituted. Examples of the substituent groups include lower alkyl groups (for example, methyl and ethyl), alkoxyl groups (for example, methoxy and ethoxy), phenoxy groups (for example, unsubstituted phenoxy and p-chlorophenoxy), halogen atoms (for example, Cl, Br and F), alkoxycarbonyl groups (for example, ethoxycarbonyl), cyano and nitro groups.

The alkyl, aralkyl and alkenyl groups represented by $R^{12}$ and $R^{13}$ each has the same meaning as given for $R^1$ to $R^4$ of general formula (1).

Although L represents a connecting group formed by connecting 1, 3, 5, 7 or 9 methine groups with conjugated double bonds, 3 methine groups may combine to form a cyclopentene or cyclohexene ring. It may be further substituted by an alkyl group (having the same meaning as given above), a halogen atom (F, Cl or Br), an aryl group (having the same meaning as given above), $NR^{14}R^{15}$, $SR^{16}$ or $OR^{17}$. $R^{14}$, $R^{15}$, $R^{16}$ and $R^{17}$ each represents an alkyl group (having the same meaning as given above) or an aryl group (having the same meaning as given above), and $R^{14}$ and $R^{15}$ may combine with each other to form a 5- or 6-membered ring.

General formula (2) is described in detail. The anions represented by $X^-$ include halogen ions (Cl, Br and I), $ClO_4^-$, $PF_6^-$, $SbF_6^-$, $BF_6^-$, a p-toluenesulfonic acid ion and an ethyl sulfate ion. The cationic dye represented by $D^+$ has the same meaning as given for the cationic dyes of general formula (1).

General formula (3) is described in detail. The alkyl aryl, allyl, aralkyl, alkenyl, alkynyl, silyl and heterocyclic groups represented by $R^1$, $R^2$, $R^3$ and $R^4$ have the same meanings as given for those represented by $R^1$, $R^2$, $R^3$ and $R^4$ of general formula (1). The alkyl, aryl, allyl, aralkyl, alkenyl, alkynyl and heterocyclic groups represented by $R^5$, $R^6$, $R^7$ and $R^8$ have the same meanings as given for those represented by $R^1$, $R^2$, $R^3$ and $R^4$ of general formula (1).

Examples of the compounds represented by general formula (3) include tetramethylammonium n-butyltriphenylboron, tetramethylammonium n-butyltrianisylboron, tetramethyl-ammonium n-octyltriphenylboron, tetramethylammonium n-octyltrianisylboron, tetraethylammonium n-butyltriphenylboron, tetrabutylammonium n-butyltriphenylboron, tetraoctylammonium n-octyltriphenylboron, tetrabutylammonium n-dodecyltriphenylboron, trimethylhydrogenammonium n-butyltriphenylboron, tetrahydrogenammonium n-butyltriphenylboron, tetramethylammonium tetrabutylboron, tetra-n-butylammonium tetra-n-butylboron, tetramethylammonium tri-n-butyl(triphenyl-silyl)boron, tetramethylammonium n-butyl(dimethylphenyl-silyl)boron, tetraethylammonium n-octyldiphenyl(di-n-butylphenylsilyl)boron, tetramethylammonium dimethylphenyl(trimethylsilyl)boron, tetramethylammonium benzyltriphenylboron, tetrabutylammonium benzyltriphenylboron, tetramethylammonium methyltriphenylboron and tetramethylammonium tri-n-butylphenylboron. These compounds are used alone or as a combination of two or more of them.

Examples of the compounds of the present invention are enumerated below in the form based on general formula (1), but the present invention is not limited thereto.

| | $\overset{\oplus}{A^1}—CH=A^2$ | $Ph_3—\overset{\ominus}{B}\text{-n-}C_4H_9$ | |
|---|---|---|---|
| Compound | $A^1$ | $A^2$ | λmax |
| 1 | 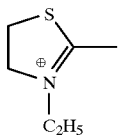 | 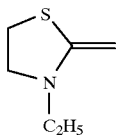 | 338 nm |
| 2 | 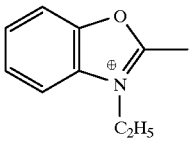 | 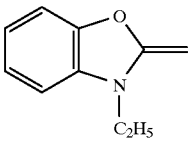 | 380 nm |
| 3 | 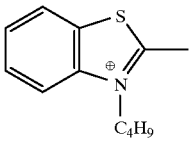 | 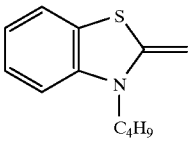 | 422 nm |
| 4 | 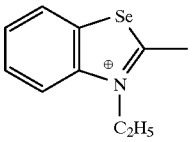 | 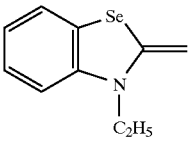 | 427 nm |
| 5 | 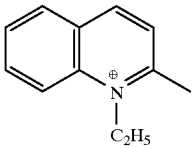 | 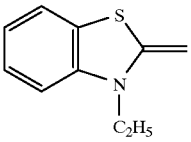 | 490 nm |
| 6 | 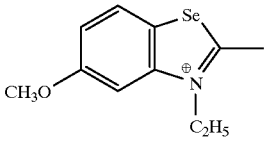 | 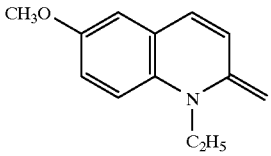 | 508 nm |
Ph represents a phenyl group.
| | $\overset{\oplus}{A^1}—CH=CH—CH=A^2$ | $Ph_3\overset{\ominus}{B}\bullet\text{n-}C_4H_9$ | |
|---|---|---|---|
| Compound | $A^1$ | $A^2$ | λmax |
| 7 | 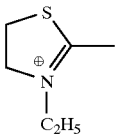 | 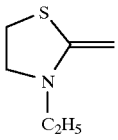 | 443 nm |
| 8 | 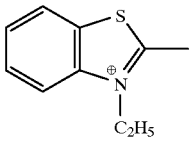 | 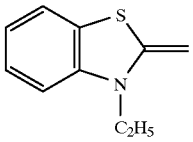 | 530 nm |

-continued
$\overset{\oplus}{A^1}$—CH═CH—CH═$A^2$ $\overset{\ominus}{Ph_3B}$•n-$C_4H_9$
| Compound | $A^1$ | $A^2$ | λmax |
|---|---|---|---|
| 9 | 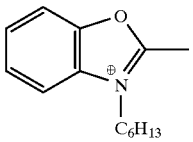 | 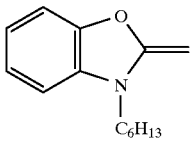 | 492 nm |
| 10 | 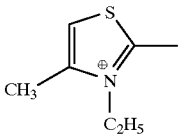 | 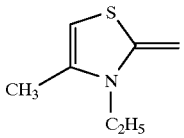 | 554 nm |
| 11 | 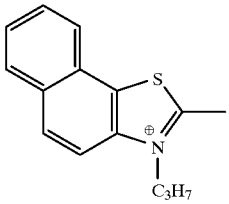 | 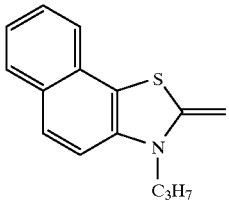 | 590 nm |
$\overset{\oplus}{A^1}$—CH═CH—CH═$A^2$ $\overset{\ominus}{Ph_3B}$•n-$C_4H_9$
| Compound | $A^1$ | $A^2$ | λmax |
|---|---|---|---|
| 12 | 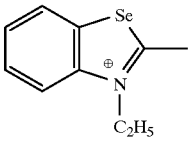 | 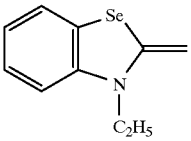 | 568 nm |
| 13 | 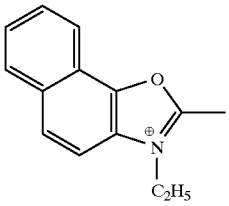 | 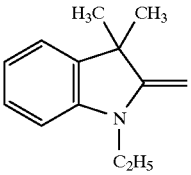 | 530 nm |
| 14 | 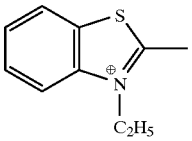 | 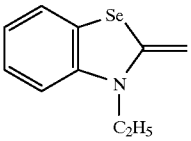 | 550 nm |
| 15 | 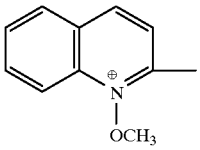 | 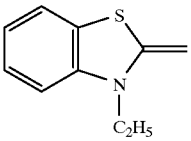 | 587 nm |

-continued $\overset{\oplus}{A^1}$—CH═CH—CH═$A^2$ $\overset{\ominus}{Ph_3B}$•n-$C_4H_9$

| Compound | $A^1$ | $A^2$ | λmax |
|---|---|---|---|
| 16 | 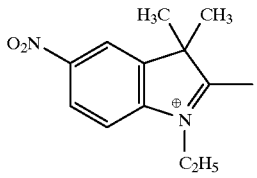 | 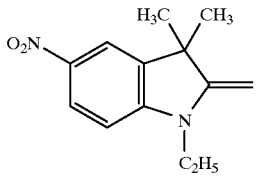 | 575 nm |
| 17 | 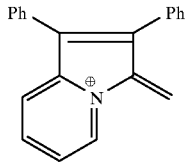 | 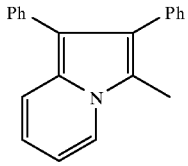 | 730 nm |

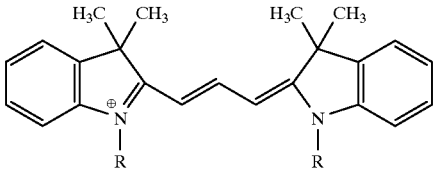

(550 nm)

$\overset{\ominus}{Ph_3B}$.R'

| Compound | R | R' |
|---|---|---|
| 18 | n-$C_4H_9$ | $CH_3$ |
| 19 | n-$C_6H_{13}$ | $CH_2Ph$ |
| 20 | n-$C_4H_9$ | 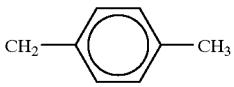 |
| 21 | n-$C_6H_{13}$ | 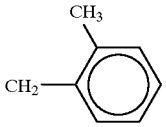 |

-continued

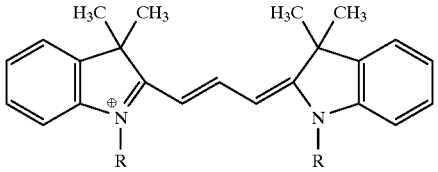

(550 nm)

$\overset{\ominus}{Ph_3B}$.R'

| Compound | R | R' |
|---|---|---|
| 22 | n-$C_4H_9$ | $CH_2CH_2CH_2Ph$ |
| 23 | n-$C_6H_{13}$ | n-$C_4H_9$ |
| 24 | n-$C_4H_9$ | $CH_3$—CH—$CH_2CH_3$ |

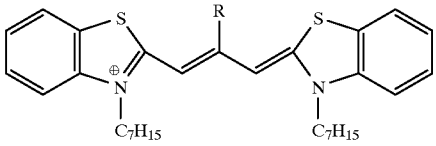

$\overset{\ominus}{Ar_3B}$•n-$C_4H_9$

| Compound | R | Ar | λmax |
|---|---|---|---|
| 25 | $CH_3$ | Ph | (552 nm) |
| 26 | —CH═CH—Ph | Ph | (556 nm) |
| 27 | H | 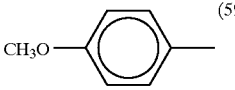 | (590 nm) |

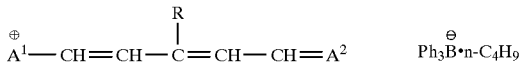
$Ph_3\overset{\ominus}{B}$•n-$C_4H_9$
| Compound | $A^1$ | $A^2$ | R | λmax |
|---|---|---|---|---|
| 28 | 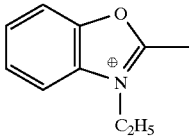 | 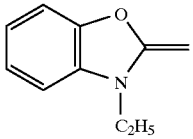 | H | 590 nm |
| 29 | 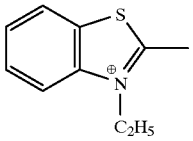 | 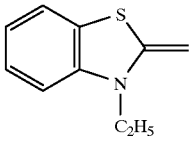 | Cl | 653 nm |
| 30 | 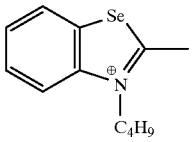 | 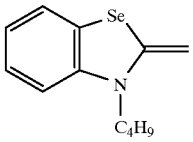 | H | 660 nm |
| 31 | 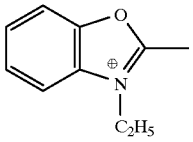 | 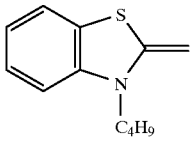 | Cl | 660 nm |
Compound 32
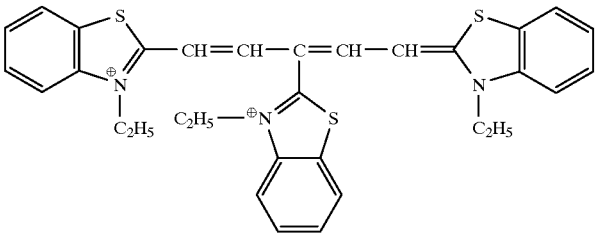
604 nm
$2Ph_3\overset{\ominus}{B}$.n-$C_4H_9$
Compound 33
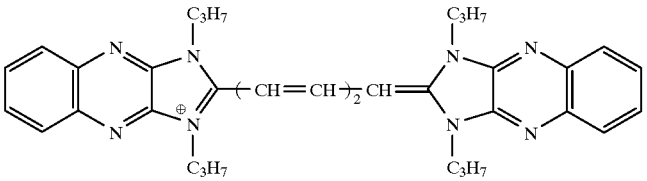
760 nm
$PH_3\overset{\ominus}{B}.CH_2Ph$

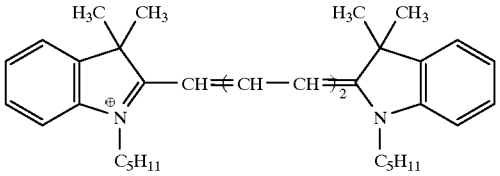
(640 nm)
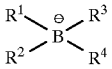
| Compound | $R^1$ | $R^2$ | $R^3$ | $R^4$ |
|---|---|---|---|---|
| 34 | Ph | Ph | Ph | n-$C_4H_9$ |
| 35 | 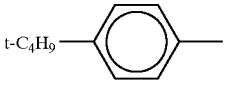 | 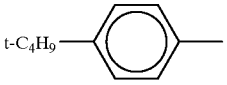 | 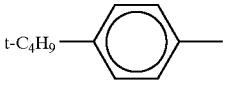 | $CH_2Ph$ |
| 36 | 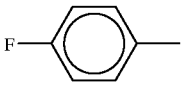 | 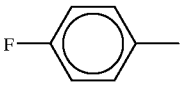 | 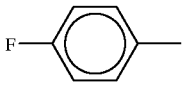 | n-$C_4H_9$ |
| 37 | 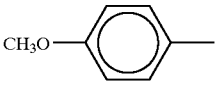 | 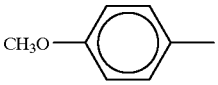 | 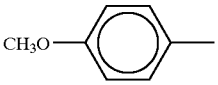 | n-$C_4H_9$ |
| 38 | 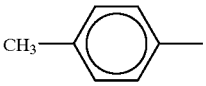 | 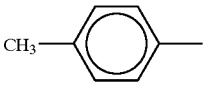 | 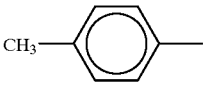 | —$CH_2Ph$ |
| 39 | n-$C_4H_9$ | n-$C_4H_9$ | n-$C_4H_9$ | n-$C_4H_9$ |
| 40 | n-$C_4H_9$ | n-$C_4H_9$ | n-$C_4H_9$ | —$Si(CH_3)_2Ph$ |
| 41 | n-$C_4H_9$ | n-$C_4H_9$ | n-$C_4H_9$ | —$SiPh_3$ |
| 42 | $CH_3$ | $CH_3$ | Ph | —$Si(CH_3)_3$ |
| 43 | Ph | Ph | Ph | —$CH_2$—CH═$CH_2$ |
| 44 | Ph | Ph | Ph | —CH═$CH_2$ |
| 45 | Ph | Ph | Ph | —$CH_2$—C≡CH |
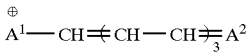
$Ph_3\overset{\ominus}{B}\cdot CH_2Ph$
| Compound | $A^1$ | $A^2$ | λmax |
|---|---|---|---|
| 46 | 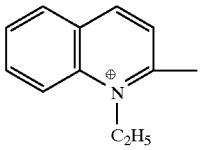 | 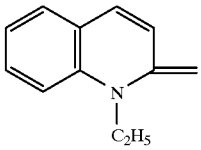 | 820 nm |
| 47 | 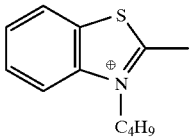 | 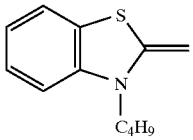 | 770 nm |

-continued
$\overset{\oplus}{A^1}$—CH═CH—CH═$_3$A$^2$ $\overset{\ominus}{Ph_3B}$•$CH_2Ph$
| Compound | A$^1$ | A$^2$ | λmax |
|---|---|---|---|
| 48 | 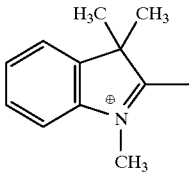 | 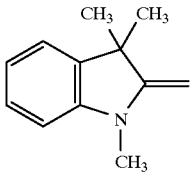 | 750 nm |
| 49 | 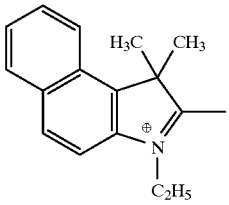 | 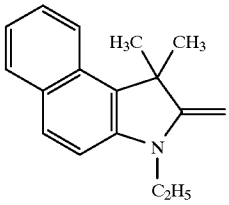 | 785 nm |
| 50 | 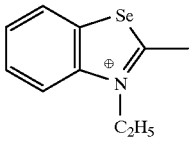 | 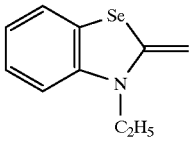 | |
$\overset{\oplus}{A^1}$—CH═CH—Q═CH—CH═A$^2$ $\overset{\ominus}{Ph_3B}$•n-$C_4H_9$
| Compound | A$^1$ | A$^2$ | Q | λmax |
|---|---|---|---|---|
| 51 | 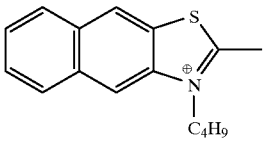 | 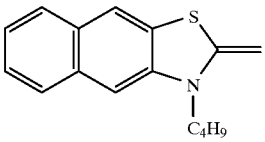 | 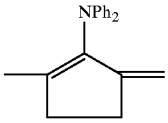 | 830 nm |
| 52 | 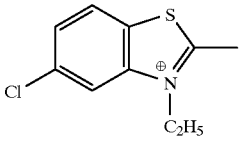 | 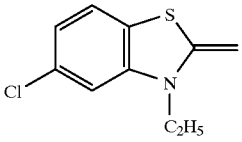 | 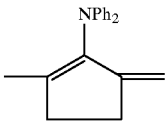 | 820 nm |
| 53 | 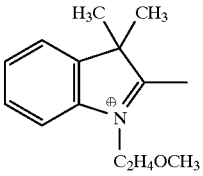 | 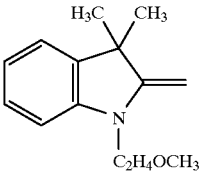 | 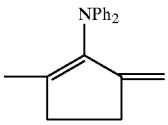 | 790 nm |

-continued $\overset{\oplus}{A^1}$—CH═CH—Q═CH—CH═$A^2$ $\overset{\ominus}{Ph_3B}$•n-$C_4H_9$

| Compound | $A^1$ | $A^2$ | Q | λmax |
|---|---|---|---|---|
| 54 | 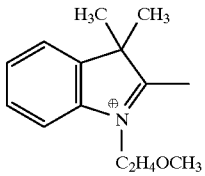 | 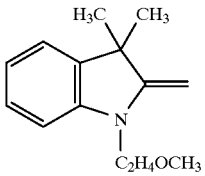 | 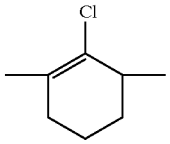 | 790 nm |
| 55 | 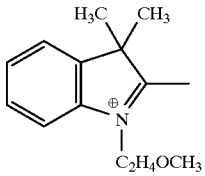 | 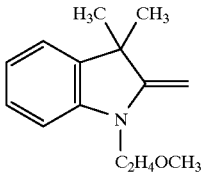 | 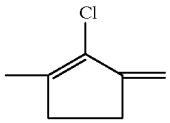 | 820 nm |
| 56 | 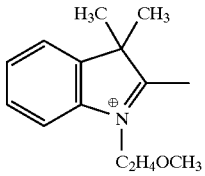 | 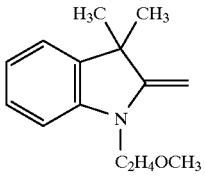 | 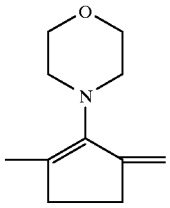 | 760 nm |

-continued $\overset{\oplus}{A}$—(CH═CH)$_n$—$C_6H_4$—R $\overset{\ominus}{Ph_3B}$•n-$C_4H_9$

| Compound | A | R | n | λmax |
|---|---|---|---|---|
| 57 | 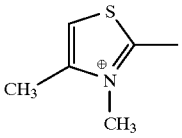 | H | 1 | 354 nm |
| 58 | 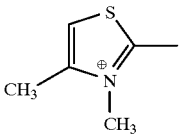 | —N($CH_3$)$_2$ | 1 | 475 nm |
| 59 | 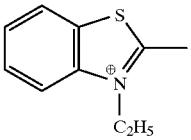 | —N($CH_3$)$_2$ | 1 | 523 nm |

-continued $\overset{\oplus}{A}$—(CH═CH)$_n$—$C_6H_4$—R $\overset{\ominus}{Ph_3B}$•n-$C_4H_9$

| Compound | A | R | n | λmax |
|---|---|---|---|---|
| 60 | 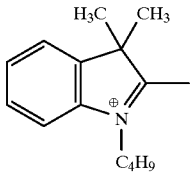 | —N($C_2H_5$)($C_2H_4OC_2H_5$) | 1 | 540 nm |
| 61 | 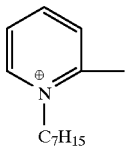 | —N($CH_3$)$_2$ | 1 | 461 nm |
| 62 | 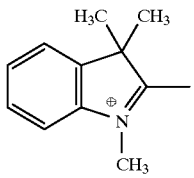 | —N($CH_3$)$_2$ | 2 | 630 nm |

$\overset{\oplus}{A^1}$—CH═CH—$A^2$ $\overset{\ominus}{Ph_3B}$•$CH_2Ph$
| Compound | $A^1$ | $A^2$ | λmax |
|---|---|---|---|
| 63 | 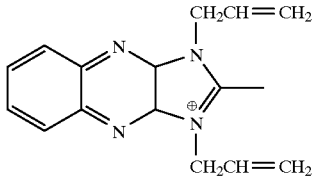 | 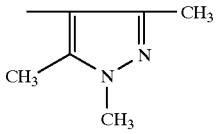 | 440 nm |
| 64 | 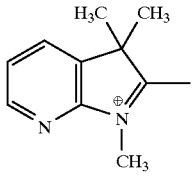 | 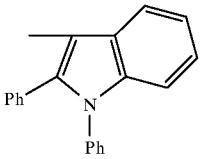 | 506 nm |
| 65 | 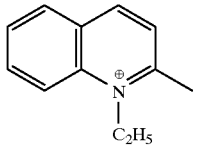 | 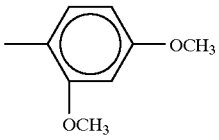 | Yellow |
| 66 | 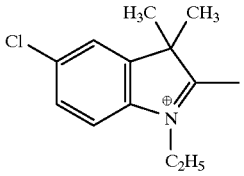 | 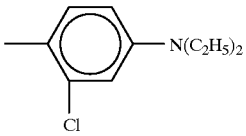 | Magenta |
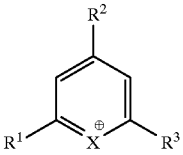
$\overset{\ominus}{Ph_3B}$•n-$C_4H_9$
| Compound | X | $R^1$ | $R^2$ | $R^3$ | λmax |
|---|---|---|---|---|---|
| 67 | S | Ph | Ph | Ph | ~350 nm |
| 68 | O | Ph | Ph | Ph | 360 nm |
| 69 | S | Ph | 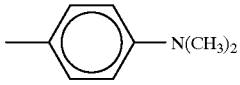 | Ph | 590 nm |
| 70 | S | t-$C_4H_9$ | 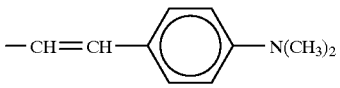 | t-$C_4H_9$ | 608 nm |

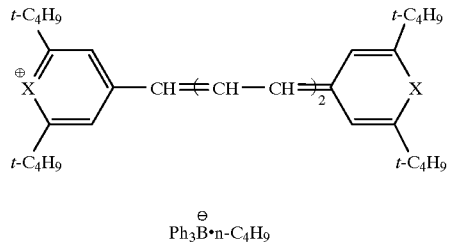
| Compound | X | λmax |
|---|---|---|
| 71 | O | 780 nm |
| 72 | S | 830 nm |
Compound 73
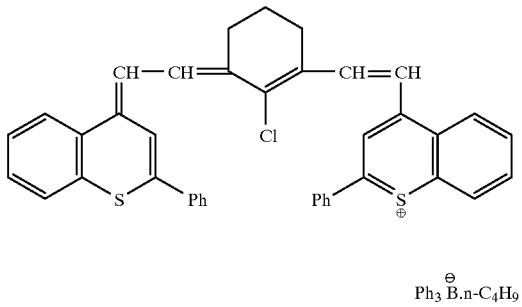
1080 nm
| Compound | A | R | R' | λmax |
|---|---|---|---|---|
| 74 | 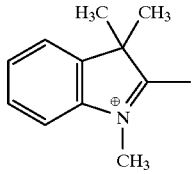 | H | H | 409 nm |
| 75 | 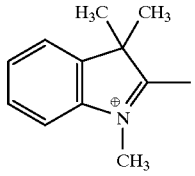 | $OCH_3$ | $OCH_3$ | 420 nm |
| 76 | 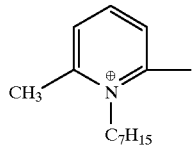 | $N(CH_3)_2$ | H | 444 nm |
Compound 77
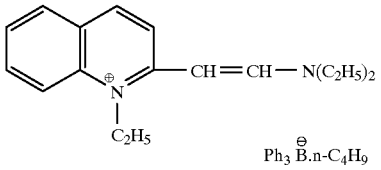
404 nm
Compound 78
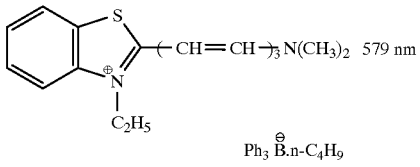
579 nm
Compound 79
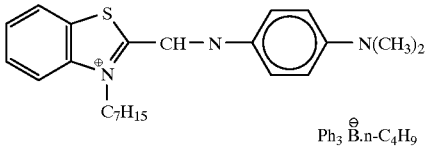
568 nm

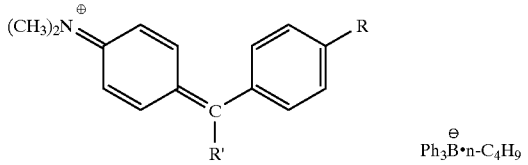
| Compound | R | R' | λmax |
|---|---|---|---|
| 80 | H | 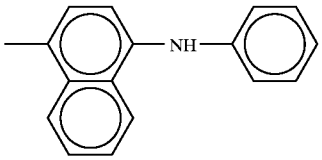 | 600 nm |
| 81 | $N(CH_3)_2$ | 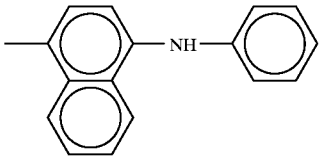 | 623 nm |
-continued
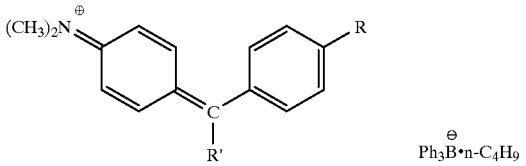
| Compound | R | R' | λmax |
|---|---|---|---|
| 82 | $N(CH_3)_2$ | 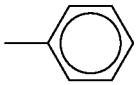 | 630 nm |
| 83 | $N(CH_3)_2$ | 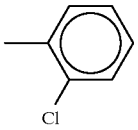 | 642 nm |
Compound 84
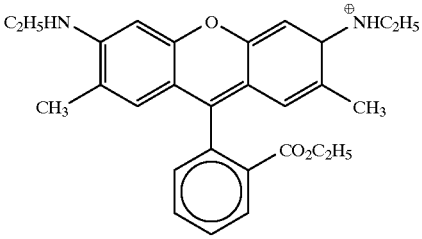
535 nm
(Rhodamine 6B)
Compound 85
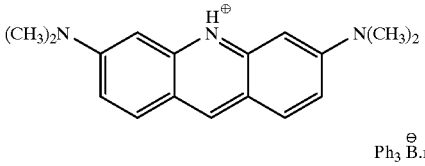
490 nm -continued
Compound 86
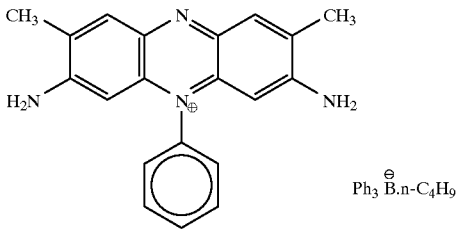
525 nm
(Safranine T)
Compound 87
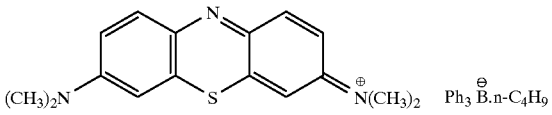
665 nm
Compound 88
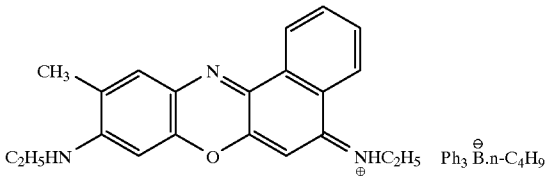
585 nm
30
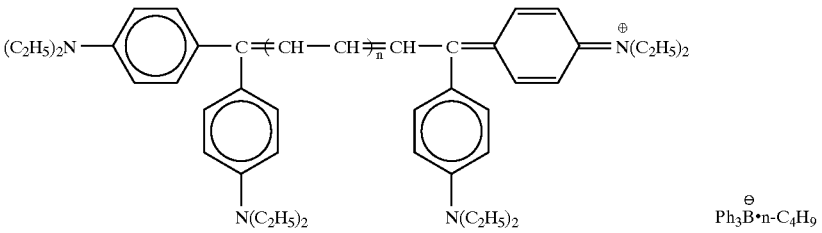
| Compound | n | λmax |
|---|---|---|
| 89 | 1 | 820 nm |
| 90 | 2 | 911 nm |
Compound 91
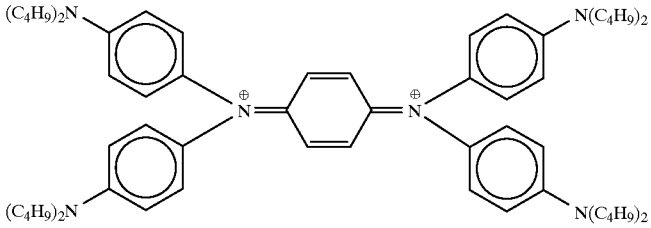
1090 nm -continued Compound 92

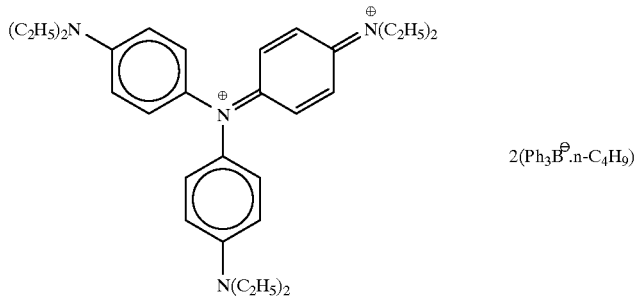

920 nm

Compound 93

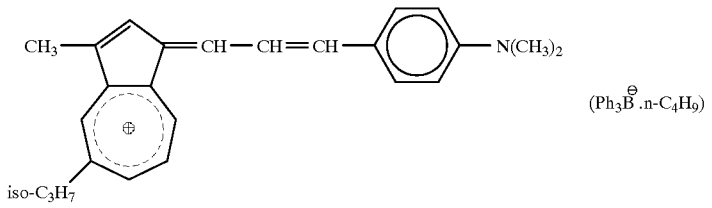

720 nm

The compounds represented by general formula (1) in the present invention can be synthesized with reference to JP-A-7-150069 and JP-A-7-150070. The compounds represented by general formula (1) can also be obtained by separately adding the compounds of general formula (2) and the compounds of general formula (3) to the photographic materials. Further, the compounds of general formula (3) may be added to the compounds of general formula (1).

The amount of these dyes coated is preferably 10 mg to 2000 mg, and more preferably 50 mg to 1000 mg, per $m^2$ of photographic material. The maximum wavelength of absorption is preferably 500 nm to 700 nm. However, there is no particular limitation on the maximum wavelength as long as the crossover light in exposure to X-rays can be absorbed.

There is no particular limitation on methods for fixing the dyes between emulsion layers and supports. Examples of such methods include a method using the dye as a solid disperse dye or using a mordant, a method using an emulsion obtained by dispersing a solution of the dye in an oil such as ethyl acetate in an aqueous solution of gelatin in the presence of a surfactant, and a method using a solution of the dye in an aqueous solution of gelatin as a coating layer.

However, it is important that these dyes do not elute in processing. They are therefore preferably dispersed in oils to apply them. Further, dyes which are high themselves in hydrophobicity or high in molecular weight to give low diffusibility in films, and dyes having substituent groups useful for increasing resistance to diffusibility are preferably used.

Silver halide grains contained in light-sensitive silver halide emulsion layers used in the present invention are silver bromide, silver chloride, silver iodide, silver chlorobromide, silver chloroiodide, silver iodobromide and silver chloroiodobromide. Other silver salts such as silver rhodanide, silver sulfide, silver selenide, silver carbonate, silver phosphate and silver salts of organic acids may be contained as additional grains, or as part of the silver halide grains. Of these, silver halide grains high in silver chloride content are particularly preferred. The silver chloride content is preferably 20% or more, and more preferably 50% to 100%.

The silver halide emulsions used in the present invention may have distributions or structures with respect to halogen composition. Typical examples thereof are disclosed in JP-B-43-13162, JP-A-61-215540, JP-A-60-222845, JP-A-60-143331, JP-A-61-75337 and JP-A-60-222844.

When the silver halide grains are used in which two or more silver halides exist as mixed crystals or with a structure, it is important to control the halogen composition distribution between the grains. A method for measuring the halogen composition distribution between the grains is described in JP-A-60-254032. In particular, a highly uniform emulsion having a coefficient of variation of 20% or less is preferred.

It is important to control the halogen composition in the vicinity of the surface of the grain. The increased content of silver iodide or silver chloride in the vicinity of the surface changes the adsorption of a dye and the rate of development, so that this can be selected according to its purpose.

The silver halide grains used in the present invention may be either normal crystals free from twin planes or crystals as explained in *The Basis of Photographic Industry, Silver Salt Photography*, page 163, edited by Nippon Shashin Gakkai (by Corona Co.) such as parallel multiple twins containing two or more parallel twin planes and non-parallel multiple twins containing two or more non-parallel twin planes. These crystals can be selected for use according to their purpose. Further, U.S. Pat. No. 4,865,964 discloses an example in which grains different in form are allowed to coexist. In the case of normal crystals, the grains having the cubic form comprising a (100) face, the octahedral form comprising a (111) face and the dodecahedral form comprising a (110) face disclosed in JP-B-55-42737 and JP-A-60-222842 can be used. Furthermore, as reported in *Journal of Imaging Science,* 30, 247 (1986), grains having (hlm) faces can be selected for use according to their purpose. Grains in which two or more faces coexist, such as a grain having the tetradecahedral form in which the (100) and (111) faces coexist in one grain, a grain in which the (100) and (110) faces coexist and a grain in which the (111) and (110) faces coexist, can also be selected for use according to their purpose. A tabular grain having (100) and (111) faces as major faces is most preferred.

The diameter of a circle equivalent to a projected area divided by the grain thickness is called the aspect ratio, which specifies the form of a tabular grain. Tabular grains having an aspect ratio of 1 or more can be used in the present invention. The tabular grains can be prepared by methods described in Cleve, *Photography Theory and Practice,* page 131 (1930), Gutoff, *Photographic Science and Engineering,* 14, 248–257 (1970), U.S. Pat. Nos. 4,434,226, 4,414,310, 4,433,048 and 4,439,520, and British Patent 2,112,157. The use of the tabular grains provides the advantages of improved covering power and increased color-sensitizing efficiency with sensitizing dyes, which is described in detail in U.S. Pat. No. 4,434,226 cited above. The average aspect ratio of 80% or more of the total projected areas of the grains is preferably 1 to less than 100, more preferably 2 to less than 20, and most preferably 3 to less than 10. As the forms of the tabular grains, triangular, hexagonal, circular and quadrilateral forms can be selected. A regular hexagon with six sides approximately equal to one another and a quadrilateral having a major face edge length ratio of about 1 as described in U.S. Pat. No. 4,797,354 are preferred forms.

In many cases, the diameter of a circle equivalent to a projected area is used as the grain size of a tabular grain. Grains having an average grain size of 0.6 μm or less as described in U.S. Pat. No. 4,748,106 are preferred for enhanced image quality. An emulsion having a narrow grain size distribution as described in U.S. Pat. No. 4,775,617 is also preferred. The limitation of the grain thickness to 0.5 μm or less is preferred in respect to enhanced sharpness, and the limitation to 0.3 μm or less is more preferred. An emulsion highly uniform in thickness, in which the grain thickness has a coefficient of variation of 30% or less, is also preferably used. Furthermore, grains described in JP-A-63-163451, in which the thickness of the grains and the distance between twin planes are specified, are also preferred.

Grains containing no dislocation line at all, grains each containing several dislocation lines, or grains each containing many dislocation lines can be selected according to their purpose. Further, grains can be selected in each of which a dislocation line is linearly introduced to a specified direction of crystal orientation of the grain or curvedly introduced. Furthermore, grains can be selected in each of which a dislocation line or dislocation lines are introduced over the entire grain or into only a specified site of the grain, for example, a fringe portion of the grain. The dislocation line is preferably introduced not only in the case of the tabular grains, but also in the case of indeterminate grains represented by normal crystal grains and potato grains.

The grain size of the emulsions used in the present invention can be evaluated by the diameter of a circle equivalent to a projected area determined under an electron microscope, the diameter of a sphere equivalent to a grain volume calculated from the projected area and a grain thickness, or the diameter of a sphere equivalent to a volume determined by the coulter counter method. The grains are selected for use from ultra-fine grains having a grain size of 0.01 μm or less to coarse grains having a grain size of more than 10 μm, calculated as the diameter of the sphere. Grains of 0.1 to 3 μm are preferably used as the light-sensitive silver halide grains.

In the present invention, either so-called multidisperse emulsions having a wider grain size distribution or monodisperse emulsions having a narrower grain size distribution can be used according to their purpose. In some cases, the coefficient of variation of the diameter of a circle equivalent to a projected area of a grain or that of the diameter of a sphere equivalent to a grain volume is used as a measure of the size distribution. When the monodisperse emulsions are used, the coefficient of variation thereof is preferably 25% or less, preferably 20% or less, and most preferably 15% or less.

In order to satisfy the desired gradation of the photographic material, for emulsion layers having substantially identical spectral sensitivity, two or more kinds of monodisperse silver halide emulsions different in grain size can be mixed in the same layers or separately applied in multiple layers. Further, two or more kinds of multidisperse silver halide emulsions or a monodisperse emulsion and a multidisperse emulsion can also be mixed or applied in multilayers to use them in combination.

High-silver chloride tabular grain emulsions most preferably used in the present invention are described below.

The silver halide emulsions comprise at least disperse media and silver halide grains, in which tabular grains having (100) or (111) faces as major faces with an aspect ratio of 2 or more occupy 50% or more, preferably 60% to 100%, most preferably 70% to 100% of the total projected areas of the silver halide grains. The tabular grains as used herein are grains having an aspect ratio (diameter/thickness) of 1 or more. The major faces mean the maximum outer surfaces of the tabular grains. The thickness of the tabular grains is 0.35 μm or less, more preferably 0.05 μm to 0.3 μm, and most preferably 0.05 μm to 0.25 μm. The aspect ratio is preferably 2 or more, more preferably 3 to 30, and most preferably 5 to 20. Here, the diameter means the diameter of a circle having an area equivalent to a projected area of the tabular grain, and the thickness means a distance between two main planes. The $Cl^-$ content is preferably 20 mol % or more, more preferably 30 mol % to 100 mol %, further preferably 40 mol % to 100 mol %, and most preferably 50 mol % to 100 mol %.

Of the emulsions used in the present invention, the nucleation of the grains having the (111) faces as the major planes is described in detail in JP-B-64-8326, JP-B-64-8325, JP-B-64-8324, JP-A-1-250943, JP-B-3-14328, JP-B-4-81782, JP-B-5-40298, JP-B-5-39459, JP-B-5-12696, JP-A-63-213836, JP-A-63-218938, JP-A-63-281149 and JP-A-62-218959. The tabular grains having the (100) faces as the major faces are described in JP-A-5-204073, JP-A-51-88017, JP-A-63-24238 and Japanese Patent Application No. 5-264059 (corresponding to JP-A-7-146522). In the present invention, the nucleation methods described in these can be arbitrarily used.

As binders or protective colloids which can be used in the photographic materials according to the present invention, gelatin is advantageously used, but other hydrophilic colloids can also be used alone or together with gelatin.

Examples of such protective colloids include proteins such as gelatin derivatives, graft polymers of gelatin with other polymers, albumin and casein; cellulose derivatives such as hydroxyethyl cellulose, carboxymethyl cellulose and cellulose sulfates; saccharide derivatives such as sodium alginate and starch derivatives; and various-kinds of synthetic hydrophilic polymers such as homopolymers and copolymers of polyvinyl alcohol, partially acetalized polyvinyl alcohol, poly-N-vinylpyrrolidone, polyacrylic acid, polymethacrylic acid, polyacrylamide, polyvinylimidazole and polyvinylpyrazole.

As gelatin, gelatin treated with an acid or gelatin treated with an enzyme as described in *Bull. Soc. Sci. Photo. Japan,* 16, 30 (1966) may be used, besides gelatin treated with lime, and a hydrolyzed or enzymatically decomposed product of gelatin can also be used. The calcium content of gelatin is preferably 800 ppm or less, and more preferably 200 ppm or less. The iron content of gelatin is preferably 5 ppm or less, and more preferably 3 ppm or less. The use of low-molecular weight gelatin described in JP-A-1-158426 is preferred for the preparation of tabular grains.

In order to prevent various molds and bacteria which propagate in hydrophilic colloidal layers to deteriorate image quality, antifungal agents as described in JP-A-63-271247 are preferably added.

It is preferred according to the purpose that salts of metal ions are allowed to coexist with the grains in the preparation of the emulsions, for example, in grain formation, in salt removal, in chemical sensitization or before coating in the present invention. When the grains are doped with the salts of metal ions, they are preferably added in the grain formation. When the salts of metal ions are used for modification of grain surfaces or as chemical sensitizers, they are preferably added after the grain formation and before the termination of the chemical sensitization. Methods of doping the whole grains with the salts of metal ions, or methods of doping only core portions of the grains, only shell portions thereof, only epitaxial portions thereof or only base grains can also be selected. Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi can be used. These metals can be added, as long as they are in the form of salts which can be dissolved in the grain formation, such as ammonium salts, acetates, nitrates, sulfates, phosphates, hydroxides, six-coordinate complex salts and four-coordinate complex salts. Examples thereof include $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$ and $K_4Ru(CN)_6$. Ligands of the coordinate compounds can be selected from halo, aquo, cyano, cyanate, thiocyanate, nitrosyl, thionitrosyl, oxo and carbonyl. These metal compounds may be used ether alone or as a combination of two or more of them.

In some cases, the methods of adding chalcogenide compounds as described in U.S. Pat. No. 3,772,031 during the preparation of the emulsions are also effective. Besides S, Se and Te, cyanides, thiocyanides, selenocyanides, carbonates, phosphates and acetates may be allowed to be present.

The silver halide grains used in the present invention can be subjected to at least one of sulfur sensitization, selenium sensitization, tellurium sensitization (these three kinds of sensitization methods are generically named chalcogen sensitization), noble metal sensitization, and reduction sensitization, in any step in the production of the silver halide emulsions. Two or more kinds of sensitization methods are preferably combined. Various types of emulsions can be prepared according to the step at which chemical sensitization is applied. There are the type of embedding chemically sensitized nuclei in the insides of the grains, the type of embedding chemically sensitized nuclei in positions shallow from surfaces of the grains, and the type of forming chemically sensitized nuclei on surfaces of the grains. In the emulsions used in the present invention, the positions of the chemically sensitized nuclei can be selected according to their purpose.

The chemical sensitization which can be conducted in the present invention is chalcogen sensitization alone or a combination of chalcogen sensitization and noble metal sensitization, and can be performed using active gelatin as described in T. H. James, *The Theory of the Photographic Process,* 4th ed., pages 67 to 76, Macmillan, 1977. Further, it can be conducted using sulfur, selenium, tellurium, gold, platinum, palladium, iridium or a combination of these sensitizers at a pAg of 5 to 10 at a pH of 5 to 8 at a temperature of 30° C. to 80° C. as described in *Research Disclosure*, Item 12008 (April, 1974), ibid., Item 13452 (June, 1975), ibid., Item 307105 (November, 1989), U.S. Pat. Nos. 2,642,361, 3,297,446, 3,772,031, 3,857,711, 3,901,714, 4,266,018 and 3,904,415, and British Patent 1,315,755.

The amount of the sulfur sensitizers added to the silver halide grains used in the present invention is preferably $1\times10^{-7}$ mol to $1\times10^{-3}$ mol, and more preferably $5\times10^{-7}$ mol to $1\times10^{-4}$ mol, per mol of silver halide, In selenium sensitization, known unstable selenium compounds are used. For example, selenium compounds described in U.S. Pat. Nos. 3,297,446 and 3,297,447 can be used. Specific examples of the selenium compounds which can be used include colloidal metallic selenium, selenourea derivatives (for example, N,N-dimethylselenourea and tetramethylselenourea), selenoketones (for example, selenoacetone), selenoamides (for example, selenoacetamide), selenocarboxylic acids and esters thereof, isoselenocyanates, selenides (for example, diethyl, selenide and triphenylphosphine selenide and selenophoshpates (for example, tri-p-tolyl selenophosphate). In some cases, selenium sensitization is preferably used in combination with sulfur sensitization or noble metal sensitization or both.

The amount of the selenium sensitizers used is generally $10^{-8}$ mol to $10^{-4}$ mol, and preferably $10^{-7}$ mol to $10^{-5}$ mol, per mol of silver halide, although it varies depending on selenium compounds, silver halide grains, chemical ripening conditions to be used-and the like.

As the tellurium sensitizers used in the present invention, compounds described in Canadian Patent 800,958, British Patent 1,295,462 and 1,396,696, and Japanese Patent Application Nos. 2-333819 (corresponding to JP-A-4-204640) and 3-131598 (corresponding to JP-A-4-333043) can be used.

In noble metal sensitization, salts of noble metals such as gold, platinum, palladium and iridium can be used. In particular, gold sensitization, palladium sensitization and the use of them in combination are preferred among others. In the case of gold sensitization, known compounds such as chloroauric acid, potassium chloroaurate, potassium aurothiocyanate, gold sulfide and gold selenide can be used. The palladium compounds mean salts of divalent or tetravalent palladium. Preferred examples of the palladium compounds are represented by $R_2PdX_6$ or $R_2PdX_4$, wherein R represents a hydrogen atom, an alkali metal atom or an ammonium group, and X represents a halogen atom (a chlorine, bromine or iodine atom).

Specifically, $K_2PdCl_4$, $(NH_4)_2PdCl_6$, $Na_2PdCl_4$, $(NH_4)_2PdCl_4$, $Li_2PdCl_4$, $Na_2PdCl_6$ or $K_2PdBr_4$ is preferred. The gold compounds and the palladium compounds is preferably used in combination with thiocyanates or selenocyanates.

The emulsions used in the present invention are preferably subjected to gold sensitization in combination. The amount of the gold sensitizers is preferably $1\times10^{-7}$ mol to $1\times10^{-3}$ mol, and more preferably $5\times10^{-7}$ mol to $5\times10^{-4}$ mol, per mol of silver halide. The amount of the palladium compounds is preferably within the range of $5\times10^{-7}$ mol to $1\times10^{-3}$ mol per mol of silver halide. The amount of the thiocyan compounds or the selenocyan compounds is preferably within the range of $1\times10^{-6}$ mol to $5\times10^{-2}$ mol per mol of silver halide.

The silver halide emulsions used in the present invention are preferably subjected to reduction sensitization during grain formation, after grain formation and before or during chemical sensitization, or after chemical sensitization.

For reduction sensitization as used herein, any of methods of adding reduction sensitizers, methods of conducting growth or ripening in an atmosphere of a low pAg of 1 to 7 which is called silver ripening, and methods of conducting growth or ripening in an atmosphere of a high pH of 8 to 11 which is called high. pH ripening can be selected. Further, two or more of them can also be used in combination.

As the reduction sensitizers, known reduction sensitizers such as stannous salts, ascorbic acid and derivatives thereof, amines and polyamines, hydrazine and derivatives thereof, formamidinic sulfinic acids, silane compounds and borane compounds can be selectively used. They can also be used in combination. Stannous chloride, aminoiminomethanesulfinic acid (thiourea dioxide), dimethylamine, borane, ascorbic acid and derivatives thereof are compounds which are preferred as the reduction sensitizers.

The chemical sensitization can also be carried out in the presence of a so-called chemical sensitizing aiding agent. As useful chemical sensitizing aiding agents, compounds are used which are known to depress fogging and to enhance the sensitivity in the course of the chemical sensitization, such as azaindene, azapyridazine and azapyrimidine. Examples of the chemical sensitizing aiding agents are described in U.S. Pat. Nos. 2,131,038, 3,411,914 and 3,554,757, JP-A-58-126536, JP-A-62-253159 and G. F. Duffin, *Photographic Emulsion Chemistry,* pages 138 to 143.

Oxidizing agents to silver can be used in the production of the emulsions used in the present invention. The oxidizing agents to silver mean compounds having the function of reacting with metallic silver to convert it to a silver ion. In particular, compounds are effective which convert extremely fine silver grains produced as a by-product in the course of formation of the silver halide grains and chemical sensitization to silver ions. The silver ions produced here may form either silver salts slightly soluble in water such as silver halides, silver sulfide and silver selenide, or silver salts easily soluble in water such as silver nitrate. The oxidizing agents to silver may be inorganic compounds or organic compounds. Examples of the inorganic oxidizing agents include ozone; hydrogen peroxide and adducts thereof (for example, $NaBO_2.H_2O_2.3H_2O$, $2NaCO_3.3H_2O_2$, $Na_4P_2O_7.2H_2O_2$ and $2Na_2SO_4.H_2O_2.2H_2O$); oxygen acid salts such as peroxy acid salts (for example, $K_2S_2O_8$, $K_2C_2O_6$ and $K_2P_2O_8$), peroxy complex compounds (for example, $K_2[Ti(O_2)C_2O_4].3H_2O$, $4K_2SO_4.Ti(O_2)OH.SO_2.2H_2O$ and $Na_3[VO(O_2)(C_2H_4)_2].6H_2O$), permanganates (for example, $KMnO_4$) and chromates (for example, $K_2Cr_2O_7$); halogen elements such as iodine and bromine; perhalogenates (for example, potassium periodate); salts of high valent metals (for example, potassium hexacyanoferrate (II)); and thiosulfonates.

Further, examples of the organic oxidizing agents include quinones such as p-quinone; organic peroxides such as peracetic acid and perbenzoic acid; and compounds releasing active halogen (for example, N-bromsuccinimide, chloramine T and chloramine B).

The oxidizing agents to silver are preferably used in combination with the above-mentioned reduction sensitization.

Various compounds can be added to the photographic emulsions used in the present invention for preventing fog in the production of the photographic materials, or during storage or photographic processing thereof, or for stabilizing photographic characteristics. That is, many compounds known as the antifoggants and stabilizers can be added, such as azoles, for example, benzothiazolium salts, nitroimidazoles, nitrobenzimidazoles, chlorobenzimidazoles, bromobenzimidazoles, nitroindazoles, benzotriazoles and aminotriazoles, mercaptothiazoles, mercaptobenzothiazoles, mnercaptobenzimidazoles, mercaptothiadiazoles and mercaptotetrazoles (particularly 1-phenyl-5-mercaptotetrazole); mercaptopyrimidines; mercaptotriazines; thioketo compounds such as oxazolinethione; and azaindene compounds, for example, triazaindenes, tetraazaindenes (particularly, 4-hydroxy-6-methyl(1,3,3a,7)tetraazaindene) and pentaazaindenes. For example, compounds described in U.S. Pat. Nos. 3,954,474 and 3,982,947 and JP-B-52-28660 can be used. One of the preferred compounds is described in Japanese Patent Application No. 62-47225 (corresponding to JP-A-63-212932). The antifoggants and stabilizers can be added at various times, for example, before, during or after grain formation, during washing, in dispersing after washing, before, during or after chemical sensitization, or before coating, according to their purpose.

It is preferred for exhibiting the effect of the present invention that the photographic emulsions used in the present invention are spectrally sensitized with methine dyes or the like. The dyes used include cyanine dyes, merocyanine dyes, complex cyanine dyes, complex merocyanine dyes, holopolar-cyanine dyes, hemicyanine dyes, styryl dyes and hemioxanol dyes. Dyes belonging to the cyanine-dyes, the merocyanine dyes and the complex merocyanine dyes are particularly useful. Any nuclei usually utilized in cyanine dyes as basic heterocyclic ring nuclei can be applied to these dyes. That is, there can be applied pyrroline, oxazoline, thiazoline, pyrrole, oxazole, thiazole, selenazole, imidazole, tetrazole and pyridine nuclei; nuclei in which alicyclic hydrocarbon rings are fused together with these nuclei; and benzoindolenine, indole, benzoxazole, naphthoxazole, benzothiazole, naphthothiazole, benzoselenazole, benzimidazole and quinoline nuclei. These nuclei may be substituted on carbon atoms.

To the merocyanine dyes or the complex merocyanine dyes, 5- and 6-membered heterocyclic ring nuclei such as pyrazoline-5-one, thiohydantoin, 2-thioxazolidine-2,4-dione, thiazolidine-2,4-dione, rhodanine and thiobarubituric acid nuclei can be applied as nuclei having the ketomethylene structure.

These sensitizing dyes may be used alone or in combination. The combinations of the sensitizing dyes are often used, particularly for supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and 1,507,803, JP-B-43-4936, JP-B-53-12375, JP-A-52-110618 and JP-A-52-109925.

The emulsions may contain dyes having no spectral sensitization action themselves or compounds which do not substantially absorb visible light, but exhibit supersensitization, in combination with the sensitizing dyes.

The sensitizing dyes may be added in any step of the emulsion preparation which has hitherto been known to be useful. Most normally, they are added during a period from completion of chemical sensitization up to before coating, but they can be added simultaneously with addition of the chemical sensitizers to conduct spectral sensitization and chemical sensitization at the same time as described in U.S. Pat. Nos. 3,628,969 and 4,225,666, or they can be added prior to chemical sensitization as described in JP-A-58-113928. Further, they can be added before completion of precipitation formation of the silver halide grains to initiate spectral sensitization. Furthermore, it is also possible to add these compounds in parts, namely to add a part thereof prior to chemical sensitization and the residue after chemical sensitization, as taught in U.S. Pat. No. 4,225,666, and they may be added at any time during formation of the silver halide grains, including methods described in U.S. Pat. No. 4,183,756.

The sensitizing agents can be added in an amount of $4\times10^{-6}$ to $8\times10^{-3}$ mol per mol of silver halide. When the silver halide grains have a more preferable size of 0.2 μm to 1.2 μm, the sensitizing agents are more effectively added in an amount of about $5\times10^{-5}$ mol to about $2\times10^{-3}$ mol per mol of silver halide.

The above-mentioned various additives are used in the photographic materials according to the present invention. In addition to them, however, various additives can be used according to their purpose.

These additives are described in *Research Disclosure*, Item 17643 (December, 1978), ibid., Item 18716 (November, 1979) and ibid., Item 307105 (November, 1989), and corresponding portions thereof are summarized in the following table.

TABLE 1

| Type of Additives | RD17643 | RD18716 | RD307105 |
|---|---|---|---|
| 1. Chemical Sensitizers | p. 23 | p. 648, right column | p. 996 |
| 2. Sensitivity Increasing Agents | | p. 648, right column | |
| 3. Spectral Sensitizers, Supersensitizers | p. 23–24 | p. 648, right column to p. 649, right column | p. 996, right to p. 998, right |
| 4. Brightening Agents | p. 24 | | p. 998, right |
| 5. Antifoggants, Stabilizers | p. 24–25 | p. 649, right column | p. 998, right to p. 1000, right |
| 6. Light Absorbers, Filter dyes, UV Absorbers | p. 25–26 | p. 649, right column to p. 650, left column | p. 1003, left to right |
| 7. Stain Inhibitors | p. 25, right column | p. 650, left to right columns | |
| 8. Dye Image Stabilizers | p. 25 | | |
| 9. Hardeners | p. 26 | p. 651, left column | p. 1004, right to p. 1005, left |
| 10. Binders | p. 26 | p. 651, left column | p. 1003, right to p. 1004, right |
| 11. Plasticizers, Lubricants | p. 27 | p. 650, right column | p. 1006, left to right |
| 12. Coating Aids, Surfactants | p. 26–27 | p. 650, right column | p. 1005, left to p. 1006, left |
| 13. Antistatic Agents | p. 27 | p. 650, right column | p. 1006, right to p. 1007, left |

Any develoment processing can be applied to the photographic materials of the present invention.

In particular, developing solutions containing ascorbic acid and/or its derivatives (hereinafter referred to as ascorbic acid compounds) as developing agents can be preferably used in the present invention. For example, compounds represented by general formula (I) described in JP-A-5-165161 and example compounds I-1 to I-8 and II-9 to II-12 described therein are particularly preferred.

The ascorbic acid compounds used in these developing solutions are generally known as compounds of the endiol type, the enaminol type, the endiamine type, the thiol-enol type and the enamine-thiol type. Examples of these compounds are described in U.S. Pat. No. 2,688,549 and JP-A-62-237443. Methods for synthesizing these ascorbic acid compounds are also well known, and described in, for example, Tugio Nomura and Hirohisa Ohmura, *Chemistry of Reductone,* Uchida Rokakuho Shinsha, 1969.

The ascorbic acid compounds can also be used in the form of alkali metal salts such as lithium salts, sodium salts and potassium salts. These ascorbic acid compounds are preferably used in an amount of 1 to 100 g, and more preferably in an amount of 5 to 80 g, per liter of developing solution.

In the present invention, it is particularly preferred that 1-phenyl-3-pyrazolidones or p-aminophenols are used as auxiliary developing agents together with the ascorbic acid compounds.

Examples of the 1-phenyl-3-pyrazolidone-based auxiliary developing agents which can be used in the present invention include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone and 1-p-tolyl-4-methyl-4-hydroxymethyl-3-pyrazolidone.

Examples of the p-aminophenol-based auxiliary developing agents which can be used in the present invention include N-methyl-p-aminophenol, p-aminophenol, N-(β-hydroxyethyl)-p-aminophenol, N-(4-hydroxyphenyl) glycine, 2-methyl-p-aminophenol and p-benzylaminophenol, and N-methyl-p-aminophenol is particularly preferred.

In general, these auxiliary developing agents are preferably used in an amount of 0.001 mol to 1.2 mol per liter of developing solution.

Alkali agents used for establishment of the pH include pH adjustors such as sodium hydroxide, potassium hydroxide, sodium carbonate, potassium carbonate, sodium tertiary phosphate and potassium tertiary phosphate.

Sulfites used as preservatives for the developing solutions in the present invention include sodium sulfite, potassium sulfite, lithium sulfite, ammonium sulfite, sodium bisulfite and potassium metabisulfite. The amount of sulfites to be used is preferably 0.01 mol/liter or more, and more preferably 0.02 mol/liter or more. The upper limit is preferably 2.5 mol/liter.

Besides these, preservatives described in L. F. A. Maison, *Photographic Processing Chemistry,* Focal Press, pages 226 to 229 (1966), U.S. Pat. Nos. 2,193,015 and 2,592,364 and JP-A-48-64933 may also be used.

In general, the developing solutions often contain boric acid compounds (for example, boric acid and borax) as pH buffers. However, it is preferred that the ascorbic acid-containing developing solutions used in the present invention does not substantially contain boric acid compounds.

The processing solutions used in the present invention can be prepared according to the methods described in JP-A-61-177132, JP-A-3-134666 and JP-A-3-67258.

The replenishment rate of the developing solutions is preferably not more than 10 cc/sheet of 10×12 inch size, and more preferably not more than 5 cc/sheet of 10×12 inch size. In that case, the effect is greatly exhibited.

In the processing methods of the present invention, the developing solutions can be replenished by the method described in Japanese Pat. No. Application No. 4-54131.

It is more preferred that, when a dry-to-dry process is conducted within 100 seconds, a roller of rubber material as described in JP-A-63-151943 is used as an outlet roller of a developing tank to prevent uneven development inherent in rapid processing, that the extrusion flow rate for stirring a developing solution in a tank is adjusted to 10 m/minute or more as described in JP-A-63-151944, and that a developing solution is stirred more intensively at least during development processing than during standing-by as described in JP-A-63-264758.

The amount of silver coated of the photographic materials of the present invention is preferably 6.0 $g/m^2$ or less, and most preferably 4.5 $g/m^2$ or less.

According to the present invention, favorable X-ray photographs can be taken, for example, by using the following phosphors as fluorescent intensifying screens.

Blue Light Emitting Phosphors $Y_2O_2S$:Tb, LaOBr:Tb, BaFCl:Eu

Green-Light Emitting Phosphors $Gd_2O_2S$:Tb, $LaO_2S$:Tb

UV Light Emitting Phosphors

Titanium-free hafnium zirconium germanate phosphors described in JP-A-6-11804, $YTaO_4$, $YTaO_4$:Nb Of these, the green light emitting phosphors are preferably used in the present invention, and an HG-M screen or an HG-H screen manufactured by Fuji Photo Film Co., Ltd. can be preferably used.

The photographic materials of the present invention can be applied to various photographic materials. Typical examples thereof include color negative films for general use or for movie use, color reversal films for slide use or for television use, color paper, color positive films and color reversal paper. General black and white photographic materials are particularly preferred. In particular, the photographic materials of the present invention can be used as photographic materials for the laser source, photographic materials for printing, medical direct radiographic materials, medical photofluorographic materials, CRT image-recording photographic materials, microfilms and photographic materials for general photographing.

The present invention will be illustrated in more detail with reference to examples below, but these are not to be construed as limiting the invention.

EXAMPLE 1

Preparation of (100) Tabular AgCl Emulsion A

In a reaction vessel were placed 1,582 ml of an aqueous solution of gelatin [pH 4.3, containing 19.5 g of gelatin-1 (deionized alkali-treated bone gelatin having a methionine content of about 40 $\mu$mol/g) and 7.8 ml of a 1N solution of $HNO_3$] and 13 ml of solution NaCl-1 (containing 10 g of NaCl per 100 ml), and while maintaining the temperature at 40° C., 15.6 ml portions of solution Ag-1 (containing 20 g of $AgNO_3$ per 100 ml) and solution X-1 (containing 7.05 g of NaCl per 100 ml) were simultaneously added thereto at a rate of 62.4 ml/minute and mixed. After stirring for 3 minutes, 28.2 ml portions of solution Ag-2 (containing 2 g of $AgNO_3$ per 100 ml) and solution X-2 (containing 1.4 g of KBr per 100 ml) were simultaneously mixed at a rate of 80.6 ml/minute. After stirring for 3 minutes, 46.8 ml portions of solution Ag-1 and solution X-1 were simultaneously added thereto at a rate of 62.4 ml/minute and mixed. After stirring for 2 minutes, 203 ml of an aqueous solution of gelatin (containing 1.3 g of oxidized gelatin-, 1.3 g of NaCl and a 1N solution of NaOH for adjusting the pH to 5.5) was added thereto to adjust the pCl to 1.8. Then, the temperature was elevated to 75° C. and the pCl was adjusted to 1.8, followed by ripening for 10 minutes. Thereafter, disulfide compound A was added in an amount of $1\times10^{-4}$ mol per mol of silver halide, and a fine AgCl grain emulsion (average grain diameter: 0.1 $\mu$m) was further added at an addition rate of AgCl of $2.68\times10^{-2}$ mol/minute over a 20-minute period. After the mixture was subjected to ripening for 10 minutes after addition, a precipitant was added thereto, and the mixture was cooled to 35° C. to develop precipitates, followed by washing with water. An aqueous solution of gelatin was added to adjust the pH to 6.0 at 60° C.

Disulfide Compound A

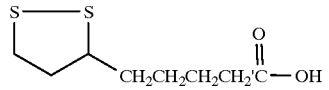

Replicas of the grains were observed under a transmission electron microscope (hereinafter abbreviated as a "TEM"). The resultant emulsion comprised (100) tabular grains having a high content of silver chloride which contained 0.44 mol % of AgBr based on silver. The shape characteristics of the grains were as follows:

(The whole projected area of tabular grains having an aspect ratio of more than 1/the 1sum of projected area of the whole AgX grains)$\times100=a_1=90\%$

[The average aspect ratio of tabular grains (average diameter/average thickness)]$=a_2=9.3$ (The average diameter of tabular grains)$=a_3 1.67$ $\mu$m (The average thickness)$=a_4 0.18$ $\mu$m Preparation of (111) Tabular AgCl Emulsion B Tabular silver chloride grains were prepared in the following manner:

Solution (1)

| | | |
|---|---|---|
| Inert Gelatin | 30 | g |
| Crystal Habit Inhibitor A | 0.6 | g |
| Crystal Habit Inhibitor B | 0.4 | g |

Crystal Habit Inhibitor A

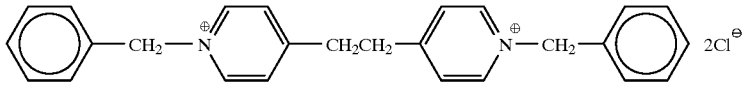

Crystal Habit Inhibitor B

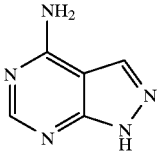

-continued

| | | |
|---|---|---|
| NaCl | 4 | g |
| Water to make | 1750 | cc |
| Solution (2) | | |
| $AgNO_3$ | 7.6 | g |
| Water to make | 30 | cc |
| Solution (3) | | |
| NaCl | 2.8 | g |
| Water to make | 30 | cc |
| Solution (4) | | |
| $AgNO_3$ | 24.5 | g |
| Water to make | 96 | cc |
| Solution (5) | | |
| NaCl | 0.3 | g |
| Water to make | 65 | cc |
| Solution (6) | | |
| $AgNO_3$ | 101.9 | g |
| Water to make | 400 | cc |
| Solution (7) | | |
| NaCl | 37.6 | g |
| Water to make | 400 | cc |

Solution (2) and solution (3) were simultaneously added with stirring to solution (1) kept at 35° C. for 1 minute at a constant rate of addition, and the temperature of the resulting solution was elevated to 70° C. for 15 minutes. At this time, grains corresponding to about 5.7% of the total amount of silver were formed. Then, solution (4) and solution (5) were simultaneously added for 24 minutes at a constant rate of addition, and solution (6) and solution (7) were further simultaneously added for 40 minutes at a constant rate of addition of the solution of silver nitrate so as to give pCl 1.0, followed by growth by the controlled double jet process to obtain a tabular silver chloride emulsion.

The emulsion was washed with water and desalted by the precipitation method, followed by addition of 30 g of gelatin and $H_2O$. Then, 2.0 g of phenoxyethanol and 0.8 g of polysodium styrenesulfonate as a thickener were further added, followed by redispersion so as to give pH 6.0 by adjustment with sodium hydroxide.

The emulsion thus obtained was an emulsion of tabular silver chloride grains having the (111) faces as the major faces, wherein $a_1$=90%, $a_3$=1.55 μm, $a_4$=0.18 μm, $a_2$=8.6, and the coefficient of variation of diameters of circles having areas equivalent to projected areas was 19%.

Preparation of (111) Tabular AgBr Grains C.

To 1 liter of water, 6.0 g of potassium bromide and 7.0 g of low molecular weight gelatin having an average molecular weight of 15,000 were added. Then, 37 cc (4.00 g of silver nitrate) of an aqueous solution of silver nitrate and 38 cc of an aqueous solution containing 5.9 g of potassium bromide were added with stirring to a vessel kept at 55° C. by the double jet process for 37 seconds. After addition of 18.6 g of gelatin, the temperature was elevated to 70° C., and 89 cc (9.80 g of silver nitrate) of an aqueous solution of silver nitrate was added for 22 minutes. At this time, 7 cc of 25% aqueous ammonia was added, and the mixture was subjected to physical ripening at the same temperature for 10 minutes, followed by addition of 6.5 cc of a 100% aqueous solution of acetic acid. Subsequently, an aqueous solution of silver nitrate (153 g) and an aqueous solution of potassium bromide were added by the double jet process for 35 minutes while being kept at pAg 8.5. Then, 15 cc of a 2N solution of potassium thiocyanate was added. The mixture was subjected to physical ripening at the same temperature for 5 minutes, followed by lowering of the temperature to 35° C. Thus, monodisperse tabular pure silver bromide grains were obtained, wherein $a_1$=95%, the average diameter of projected area, $a_3$=1.50 μm, the thickness, $a_4$=0.185 μm, the average aspect ratio, $a_2$=8.1, and the coefficient of variation of diameters of circles having areas equivalent to projected areas was 18.5%.

Then, soluble salts were removed by the precipitation method. The temperature of the grains were elevated to 40° C. again, and 30 g of gelatin, 2.35 g of phenoxyethanol and 0.8 g of polysodium styrenesulfonate as a thickener were added. The resulting mixture was adjusted to pH 5.90 and pAg 8.00 with sodium hydroxide and a solution of silver nitrate.

Preparation of (100) Tabular AgBrCl Emulsion D

In a reaction vessel were placed 1,582 ml of an aqueous solution of gelatin [pH 4.3, containing 19.5 g of gelatin-1 (deionized alkali-treated bone gelatin having a methionine content of about 40 μmol/g) and 7.8 ml of a 1N solution of $HNO_3$] and 13 ml of solution NaCl-1 (containing 10 g of NaCl per 100 ml), and while maintaining the temperature at 40° C., 15.6 ml portions of solution Ag-1 (containing 20 g of $AgNO_3$ per 100 ml) and solution X-1 (containing 7.05 g of NaCl per 100 ml) were simultaneously added thereto at a rate of 62.4 ml/minute and mixed. After stirring for 3 minutes, 28.2 ml portions of solution Ag-2 (containing 2 g of $AgNO_3$ per 100 ml) and solution X-2 (containing 1.4 g of KBr per 100 ml) were simultaneously mixed at a rate of 80.6 ml/minute. After stirring for 3 minutes, 46.8 ml portions of solution Ag-1 and solution X-1 were simultaneously added thereto at a rate of 62.4 ml/minute and mixed. After stirring for 2 minutes, 203 ml of an aqueous solution of gelatin (containing 13 g of oxidized gelatin-1, 1.3 g of NaCl and a 1N solution of NaOH for adjusting the pH to 5.5) was added thereto to adjust the pCl to 1.8. Then, the temperature was elevated to 75° C. and the pCl was adjusted to 1.8, followed by ripening for 10 minutes. Thereafter, solution Ag-3 (containing 50 ml of 100% $AgNO_3$ per 100 ml) and solution X-3 (containing 23.5 g of NaCl and 71.4 g of KBr per 100 ml) were prepared and added, establishing the rate of addition of silver nitrate to $2.68\times10^{-2}$ mol/minute, followed by growth at a pCl of 1.8 for 20 minutes by the controlled double jet process.

Preparation of (111) Tabular AgBrCl Emulsions E and F

Tabular silver chloride grains were prepared in the following manner:

| | | |
|---|---|---|
| Solution (1) | | |
| Inert Gelatin | 30 | g |
| Crystal Habit Inhibitor A | 0.6 | g |
| Crystal Habit Inhibitor B | 0.4 | g |
| Crystal Habit Inhibitor A | | |

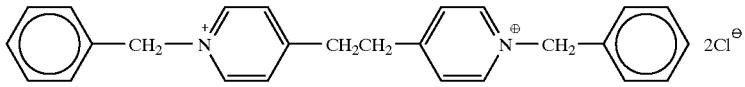

| | | |
|---|---|---|
| Crystal Habit Inhibitor B | | |

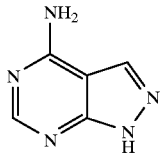

| | | |
|---|---|---|
| NaCl | 4 | g |
| Water to make | 1750 | cc |
| Solution (2) | | |
| $AgNO_3$ | 7.6 | g |
| Water to make | 30 | cc |
| Solution (3) | | |
| NaCl | 2.8 | g |
| Water to make | 30 | cc |
| Solution (4) | | |
| $AgNO_3$ | 24.5 | g |
| Water to make | 96 | cc |
| Solution (5) | | |
| NaCl | 0.3 | g |
| Water to make | 65 | cc |
| Solution (6) | | |
| $AgNO_3$ | 101.9 | g |
| Water to make | 400 | cc |
| Solution (7) | | |
| NaCl | 14.4 | g |
| KBr | 47.0 | g |
| Water to make | 400 | cc |

After the mixture was subjected to ripening for 10 minutes after addition, a precipitant was added thereto, and the mixture was cooled to 35° C. to develop precipitates, followed by washing with water. An aqueous solution of gelatin was added to adjust the pH to 6.0 at 60° C. Replicas of the grains were observed under a TEM. The resultant emulsion comprised (100) tabular grains having a high content of silver chloride which contained about 53 mol % of AgBr based on silver. The shape characteristics of the grains were as follows:

(The whole projected area of tabular grains having an aspect ratio of more than 1/the sum of projected area of the whole AgX grains)×100=$a_1$=90%

[The average aspect ratio of tabular grains (average diameter/average thickness)]=$a_2$=9.3

(The average diameter of tabular grains)=$a_3$=1.67 μm (The average thickness)=$a_4$=0.18 μm Solution (2) and solution (3) were simultaneously added with stirring to solution (1) kept at 35° C. for 1 minute at a constant rate of addition, and the temperature of the resulting solution was elevated to 70° C. for 15 minutes. At this time, grains corresponding to about 5.7% of the total amount of silver were formed. Here, disulfide compound B was added in an amount of $1\times10^{-4}$ mol per mol of silver halide. Then, solution (4) and solution (5) were simultaneously added for 24 minutes at a constant rate of addition, and solution (6) and solution (7) were further simultaneously added for 40 minutes at a constant rate of addition of the solution of silver nitrate so as to give pCl 1.0, followed by growth by the controlled double jet process to obtain a tabular silver chloride emulsion.

The emulsion was washed with water and desalted by the precipitation method, followed by addition of 30 g of gelatin and $H_2O$. Then, 2.0 g of phenoxyethanol and 0.8 g of polysodium styrenesulfonate as a thickener were further added, followed by redispersion so as to give pH 6.0 by adjustment with sodium hydroxide. The emulsion thus obtained was an emulsion of tabular silver chloride grains containing about 50% of Br and having the (111) faces as the major faces, wherein $a_1$=90%, $a_3$=1.55 μm, $a_4$=0.18 μm, $a_2$=8.6, and the coefficient of variation of diameters of circles having areas equivalent to projected areas was 19%.

Disulfide Compound B

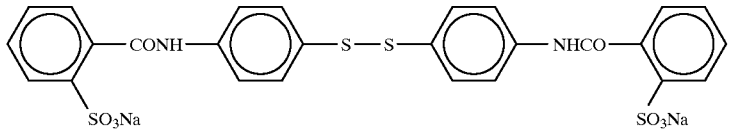

In the preparation of the above-mentioned tabular grains, such growth conditions that the shapes of the grains such as the aspect ratio and the grain size became approximately similar to those of the original tabular grains were selected and the KBr content of solution (7) was adjusted to prepare tabular silver chlorobromide emulsions E and F having silver chloride contents of 17% and 24%, respectively, and having the (111) faces as the major faces.

Preparation of Monodisperse Cubic Silver Halide Emulsion G

In 1 liter of water, 32 g of gelatin was dissolved, and 0.3 g of potassium bromide, 5 g of sodium chloride and 46 mg of compound [I]

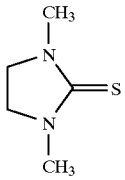

were placed in a vessel heated to 53° C. Then, 444 ml of an aqueous solution containing 80 g of silver nitrate and 452 ml of aqueous solution containing 5.5 g of sodium chloride were added by the double jet process for about 20 minutes. Subsequently, 400 ml of an aqueous solution containing 80 g of silver nitrate and 415 ml of an aqueous solution containing 46.4 g of potassium bromide, 5.7 g of sodium chloride and $10^{-7}$ mol/(mol of silver) of potassium hexachloro-iridate (III) were added by the double jet process for about 25 minutes to prepare monodisperse cubic silver chlorobromide grains having an average grain size (a diameter of a circle having an area equivalent to a projected area) of 0.34 μm and a coefficient of variation of diameters of circles having areas equivalent to projected areas of 10%.

This emulsion was desalted by the coagulation method, followed by addition of 62 g of gelatin and 1.75 g of phenoxyethanol, and the mixture was adjusted to pH 6.5 and pAg 8.5.

Chemical Sensitization

The grains prepared as described above were each subjected to chemical sensitization with stirring and maintaining at 60° C. First, thiosulfonic acid compound-1 was added in an amount of $10^{-4}$ mol per mol of silver halide, and then, fine AgBr grains having a diameter of 0.10 μm was added in an amount of 1.0 mol % based on the total amount of silver. After 5 minutes, a 1% solution of KI was added in an amount of $10^{-3}$ mol per mol of silver halide, and further after 3 minutes, thiourea dioxide was added in an amount of $1\times10^{-6}$ mol per mol of Ag. The mixture was kept as such for 22 minutes, and subjected to reduction sensitization. Then, $3\times10^{-4}$ mol per mol of Ag of 4-hydroxy-6-methyl-1,3,3a,7-tetraazaindene, sensitizing dye-1 and sensitizing dye-2 were each added. Calcium chloride was further added. Furthermore, $1\times10^{-5}$ mol per mol of Ag of chloroauric acid and $3.0\times10^{-3}$ mol per mol of Ag of potassium$^-$ thiocyanate were added, and subsequently, sodium thiosulfate ($6\times10^{-6}$ mol per mol of Ag) and selenium compound-I ($4\times10^{-6}$ mol per mol of Ag) were added. In addition, after 3 minutes, nucleic acid (0.5 g/mol of Ag) was added, and after the elapse of 40 minutes, water-soluble mercapto compound-I was added, followed by cooling to 35° C.

Thus, the preparation of the emulsions (chemical ripening) was terminated.

Thiosulfonic Acid Compound-1: $C_2H_5SO_2SNa$

Sensitizing Dye-1

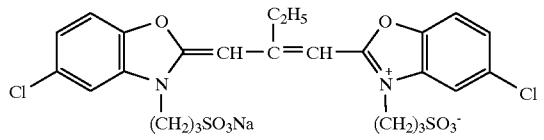

$1 \times 10^{-3}$ mol/mol of Ag

Sensitizing Dye-2

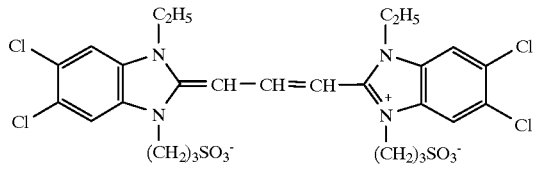

$1 \times 10^{-5}$ mol/mol of Ag

-continued

Selenium Compound-I

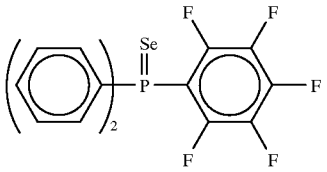

Water-Soluble Mercapto Compound-1

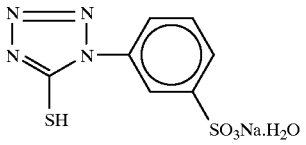

Preparation of Emulsion Coating Layers

The following chemicals per mol of silver halide were added to emulsions A to G subjected to-chemical sensitization to make emulsion coating solutions.

| | |
|---|---|
| Gelatin<br>(also including gelatin in the emulsion) | 111 g |
| Dextran<br>(average molecular weight: 39,000) | 21.5 g |
| Polysodium Acrylate<br>(average molecular weight: 400,000) | 5.1 g |
| Polysodium Styrenesulfonate<br>(average molecular weight: 600,000) | 1.2 g |
| Potassium Iodide | 78 mg |
| Hardener<br>1,2-bis(vinylsulfonylacetamide)ethane<br>The amount to be added was adjusted so that the degree of swelling reached 170%. | |
| Compound-1 | 42.1 mg |
| Compound-2 | 10.3 g |
| Compound-3 | 0.11 g |
| Compound-4 | 8.5 mg |
| Compound-5 | 0.43 g |
| Compound 6 | 20 mg |
| Compound 7 | 30 mg |
| (Adjusted to pH 6.1 with NaOH) | |

Compound-1

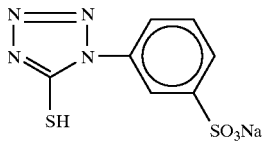

Compound-2

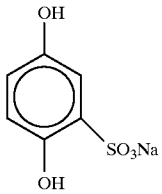

-continued

Compound-3

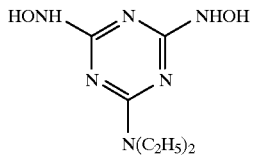

Compound-4

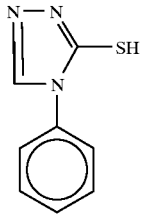

Compound-5

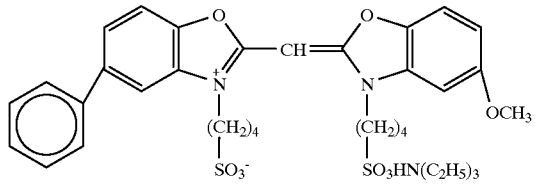

Compound-6

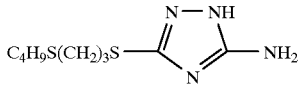

Compound-7

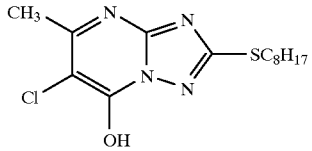

Dye emulsion A was added to the above-mentioned coating solutions so that dye-I was applied in an amount of 10 mg/m$^2$ per one side.

Dye-I

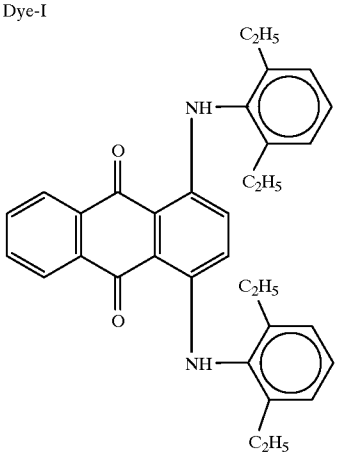

Preparation of Dye Emulsion A

Sixty grams of dye-1 described above was dissolved in 62.8 g of high-boiling organic solvent-I shown below, 62.8 g of high-boiling organic solvent-II shown below and 333 g of ethyl acetate at 60° C. Then, 65 cc of a 5% aqueous solution of sodium dodecylbenzenesulfonate, 94 g of gelatin and 581 cc of water were added thereto, and the mixture was emulsified at 60° C. for 30 minutes using a dissolver. Thereafter, 2 g of compound-8 shown below and 6 liters of water were added, and the mixture was cooled to 40° C. Then, the mixture was concentrated using Ultrafiltration Labomodule ACP1050 manufactured by Asahi Chemical Industry Co., Ltd. until the whole amount reached 2 kg, and 1 g of compound-8 described above was added to make dye emulsion A.

High Boiling Organic Solvent-I

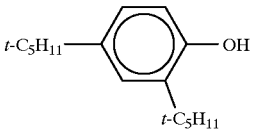

High Boiling Organic Solvent-II

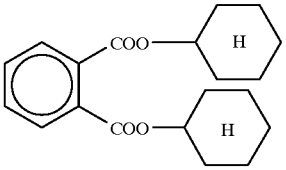

Compound-8

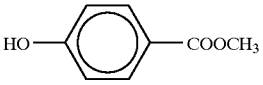

Preparation of Coating Solution for Surface Protecting Layer

A coating solution for a surface protecting layer was prepared so as to give the following amounts of respective components coated.

| | |
|---|---|
| Gelatin | 0.780 g/m$^2$ |
| Polysodium Acrylate (average molecular weight: 400,000) | 0.025 g/m$^2$ |
| Polysodium Styrenesulfonate (average molecular weight: 600,000) | 0.0012 g/m$^2$ |
| Polymethyl Methacrylate (average particle size: 3.7 $\mu$m) | 0.072 g/m$^2$ |
| Compound-9 | 0.018 g/m$^2$ |
| Compound-10 | 0.037 g/m$^2$ |
| Compound-11 | 0.0068 g/m$^2$ |
| Compound-12 | 0.0032 g/m$^2$ |
| Compound-13 | 0.0012 g/m$^2$ |
| Compound-14 | 0.0022 g/m$^2$ |
| Compound-15 | 0.030 g/m$^2$ |
| Proxel (Adjusted to pH 6.8 with NaOH) | 0.0010 g/m$^2$ |

Compound-9

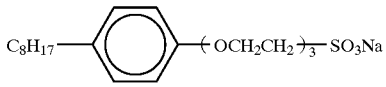

Compound-10

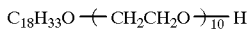

Compound-11

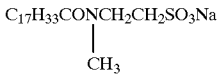

Compound-12

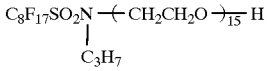

Compound-13

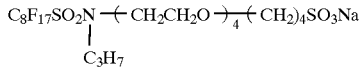

Compound-14

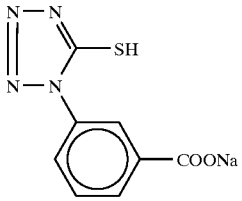

Compound-15

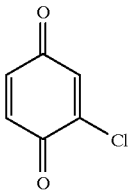

Preparation of Support (1) Preparation of Dye Dispersion d for Undercoat Layer

Dye-II shown below was treated in a ball mill by the method described in JP-A-63-197943.

Dye-II

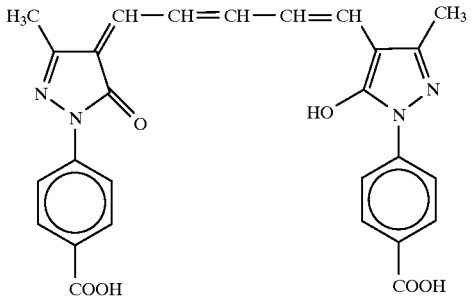

In a 2-liter ball mill, 434 cc of water and 791 cc of a 6.7% aqueous solution of a Triton X200 (registered trade mark) surfactant (TX-200 (registered trade mark)) were placed. Twenty grams of the dye was added to the solution. Then, 400 ml of beads (2 mm in diameter) of zirconium oxide ($ZrO_2$) were added, and the contents were pulverized for 4 days, followed by addition of 160 g of 12.5% gelatin. After deaeration, the $ZrO_2$ beads were removed by filtration. Observation of the resulting dye dispersion showed that the pulverized dye grains were widely distributed in size from 0.05 $\mu$m to 1.15 $\mu$m, with an average grain size of 0.37 $\mu$m. Further, dye grains having a size of 0.9 $\mu$m or more were removed by centrifugation. Thus, dye dispersion d was obtained.

(2) Preparation of Support

A biaxially oriented polyethylene terephthalate film having a thickness of 175 $\mu$m was subjected to corona discharge, and coated with a first undercoat-solution having the following composition with a wire converter so as to give an amount coated of 4.9 cc/m$^2$, followed by drying at 185° C. for 1 minute.

Then, a first undercoat layer was similarly formed also on the opposite surface. Polyethylene terephthalate used contained the following dyes:

| | |
|---|---|
| Dye-III | 0.04% by weight |
| Dye-IV | 0.02% by weight |
| Dye-V | 0.02% by weight |

Dye-III

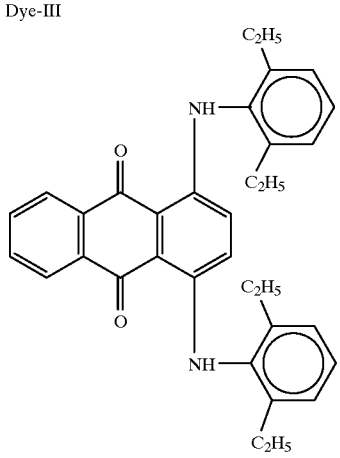

Dye-IV

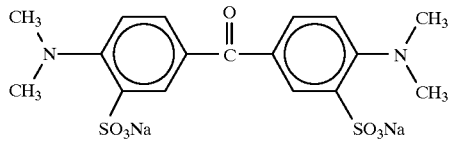

Dye-V

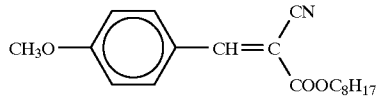

| First Undercoat Solution | |
|---|---|
| Butadiene-Styrene Copolymer Latex Solution (solid content: 40%, weight ratio of butadiene/styrene = 31/69) | 158 cc |
| 4% Solution of Sodium Salt of 2,4-Dichloro-6-hydroxy-s-triazine | 41 cc |
| Distilled Water | 801 cc |

*The latex solution contained 0.4% by weight of the following emulsifying dispersing agent, based on the latex solid content:

Emulsifying Dispersing Agent

Containing

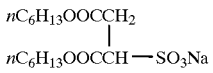

in an amount of 0.4% by weight based on the solid content of latex (3) Coating of Undercoat Layer The above-mentioned first undercoat layers on both surfaces were each coated with a second undercoat solution having the following composition with a wire converter at 155° C. so as to give the amounts coated described below, followed by drying.

| | |
|---|---|
| Gelatin | 80 mg/m$^2$ |
| Dye Dispersion d (as the dye solid content) | 15 mg/m$^2$ |
| Compound A-16 | 1.8 mg/m$^2$ |
| Compound A-17 | 0.27 mg/m$^2$ |
| Matte Agent (polymethyl methacrylate having an average grain size of 2.5 $\mu$m) | 2.5 mg/m$^2$ |

Compound A-16

$C_{12}H_{25}O(CH_2CH_2O)_{10}H$

Compound A-17

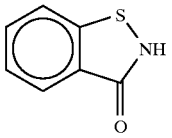

Preparation of Photographic Materials

The support prepared as described above was coated on the both surfaces with a combination of the above-mentioned emulsion layer and surface protective layer by the co-extrusion process. The amount of silver coated per one surface was 1.40 g/m$^2$. The swelling rate determined by the amount of gelatin coated and lyophilization with liquid nitrogen was adjusted to 170% by the amounts of gelatin and a hardener added to the emulsion layer. Coated samples (samples for comparison) thus prepared are shown in Table 2 as A1 to A7.

TABLE 2

| Sample | Emulsion |
|---|---|
| A1 | A |
| A2 | B |
| A3 | C |
| A4 | D |
| A5 | E |
| A6 | F |
| A7 | G |

Photographic materials shown in Tables 3 and 4 were prepared in the same manner as with the coated samples thus prepared with the exception that dye dispersion d was not introduced in the second undercoat layers in the preparation of the supports, but the following intermediate layers were provided between the emulsion coated layers and the supports.

Preparation of Intermediate Layer-1

Coating solutions were prepared so that respective coating components are applied in amounts shown below, and applied.

| | | |
|---|---|---|
| Gelatin | (per one surface) | 0.5 g/m$^2$ |
| Compounds of Tables 3 and 4 | (per one surface) | amounts of Tables 3 and 4 |

TABLE 3

| Sample | Emulsion | Processing Decolorization Type Dye | |
|---|---|---|---|
| B1 | A | S-1 | 50 mg/m$^2$ |
| B2 | B | S-11 | " |
| B3 | C | S-15 | " |
| B4 | A | L-6 | 50 mg/m$^2$ |
| | | K-2 | 40 mg/m$^2$ |
| B5 | B | L-10 | 50 mg/m$^2$ |
| | | K-10 | 40 mg/m$^2$ |
| B6 | C | L-3 | 30 mg/m$^2$ |
| | | K-5 | 40 mg/m$^2$ |
| B7 | A | 40 | 30 mg/m$^2$ |
| B8 | B | 19 | 50 mg/m$^2$ |
| B9 | C | 23 | 40 mg/m$^2$ |
| B10 | A | not added | |
| B11 | B | not added | |
| B12 | C | not added | |
| B13 | D | S-15 | 50 mg/m$^2$ |
| B14 | E | " | " |
| B15 | F | " | " |

TABLE 4

| Sample | Emulsion | Processing Decolorization Type Dye | |
|---|---|---|---|
| B16 | G | L-10 | 50 mg/m$^2$ |
| B17 | D | " | " |
| B18 | E | " | " |
| B19 | F | " | " |
| B20 | G | " | " |
| B21 | D | 23 | 40 mg/m$^2$ |
| B22 | E | " | " |
| B23 | F | " | " |
| B24 | G | " | " |

Evaluation of Photographic Characteristics

The photographic materials were allowed to stand at a temperature of 25° C. and a relative humidity of 50% for 7 days, and thereafter subjected to desired tests.

Each photographic material was brought into close contact with an UV screen (Ultra Vision First Detail, manufactured by E. I. du Pont de Nemours and Company), a GRENEX orthoscreen HR-4 and an HG-M screen manufactured by Fuji Photo and Film Co., Ltd. on both sides thereof, and exposed to X-rays for a period of 0.05 second from the both sides to conduct X-ray sensitometory.

The exposure was adjusted by changing the distance between an X-ray tube and a cassette. After exposure, the photographic material was processed with an automatic processor by use of the following developing solution and fixing solution.

A Fuji X-ray processor (CEPROS-30, manufactured by Fuji Photo and Film Co., Ltd.) was used as an automatic processor. The total processing time (dry to dry) was established to 30 seconds, and the blow-off temperature of drying air was set to 55° C.

| Formulation of Development Replenisher | | |
|---|---|---|
| Part A | | |
| Potassium Hydroxide | 18.0 | g |
| Potassium Sulfite | 30.0 | g |
| Sodium Carbonate | 30.0 | g |
| Diethylene Glycol | 10.0 | g |
| Diethylenetriaminepentaacetic Acid | 2.0 | g |
| 1-(N,N-Diethylamino)ethyl-5-mercaptotetrazole | 0.1 | g |
| L-Ascorbic | 43.2 | g |
| 4-Hydroxymethyl-4-methyl-1-phenyl-3-pyrazolidone | 2.0 | g |

-continued

| Formulation of Development Replenisher | | |
|---|---|---|
| Water to make | 300 | ml |
| Part B | | |
| Triethylene Glycol | 45.0 | g |
| 3,3'-Dithiobishydrocinnamic Acid | 0.2 | g |
| Glacial Acetic Acid | 5.0 | g |
| 5-Nitroindazole | 0.3 | g |
| 1-Phenyl-3-pyrazolidone | 3.5 | g |
| Water to make | 60 | ml |
| Part C | | |
| Glutaraldehyde (50%) | 10.0 | g |
| Potassium Bromide | 4.0 | g |
| Potassium Metabisulfite | 10.0 | g |
| Water to make | 50 | ml |

Water was added to 300 ml of part A, 60 ml of part B and 50 ml of part C to bring the volume to 1 liter, and the pH was adjusted to 10.90.

Development Initiator

Acetic acid was added to the above-mentioned development replenisher to adjust the pH to 10.20, and the resulting solution was used as a development initiator.

Fixing Solution

A CE-F1 fixing solution manufactured by Fuji Photo and Film Co., Ltd. was used as a fixing solution. The pH was adjusted to 5.0.

Developing Temperature. 35° C.

Fixing Temperature. 35° C.

Drying Temperature. 55° C.

For each sample, 600 films having a size of 10×12 inches were subjected to running processing at a replenishment rate of 5 ml/10×21 inches (65 ml/$m^2$) for both the developing solution and the fixing solution. The photographic materials of the present invention showed good characteristics.

The coloring degree of the processing solutions and the residual color of the photographic materials were evaluated. Results thereof are shown in Table 5.

TABLE 5

| Sample | Coloring of Developing Solution | Coloring of Fixing Solution | Residual Color |
|---|---|---|---|
| A1 | x | x | x |
| A2 | x | x | x |
| A3 | x | x | x |
| A4 | x | x | x |
| A5 | x | x | x |
| A6 | x | x | x |
| A7 | x | x | x |
| B1 | ○ | ○ | ○ |
| B2 | ○ | ○ | ○ |
| B3 | ○ | ○ | Δ |
| B4 | ○ | ○ | ○ |
| B5 | ○ | ○ | ○ |
| B6 | ○ | ○ | Δ |
| B7 | ○ | ○ | x |
| B8 | ○ | ○ | x |
| B9 | ○ | ○ | x |
| B10 | ○ | ○ | ○ |
| B11 | ○ | ○ | ○ |
| B12 | ○ | ○ | ○ |
| B13 | ○ | ○ | ○ |
| B14 | ○ | ○ | ○ |
| B15 | ○ | ○ | Δ |
| B16 | ○ | ○ | Δ |
| B17 | ○ | ○ | ○ |
| B18 | ○ | ○ | ○ |

TABLE 5-continued

| Sample | Coloring of Developing Solution | Coloring of Fixing Solution | Residual Color |
|---|---|---|---|
| B19 | ○ | ○ | Δ |
| B20 | ○ | ○ | Δ |
| B21 | ○ | ○ | x |
| B22 | ○ | ○ | x |
| B23 | ○ | ○ | x |
| B24 | ○ | ○ | x |

○: Good, Δ: Moderate, x: Much colored

After processing, samples B7 to B9 and B21 to B24 were exposed to a white light source of 100,000 luxes for 60 seconds. The residual color at that time was evaluated again. As a result, results shown Table 6 were obtained.

TABLE 6

| Sample | Residual Color |
|---|---|
| B7 | ○ |
| B8 | ○ |
| B9 | Δ |
| B21 | ○ |
| B22 | ○ |
| B23 | Δ |
| B24 | Δ |

○: Good, Δ: Moderate, x: Much colored

The crossover light was measured by the method described in JP-A-1-172828 with the exception that the samples were processed according to the method of the example described above in this specification. As a result, all of the samples of the present invention showed a crossover light of 30% or less.

TABLE 7

| Sample | Crossover Light | |
|---|---|---|
| A1 | 18% | Comparison |
| A2 | 15% | Comparison |
| A3 | 17% | Comparison |
| A4 | 20% | Comparison |
| A5 | 16% | Comparison |
| A6 | 15% | Comparison |
| A7 | 20% | Comparison |
| B1 | 6% | Invention |
| B2 | 8% | Invention |
| B3 | 10% | Invention |
| B4 | 6% | Invention |
| B5 | 4% | Invention |
| B6 | 12% | Invention |
| B7 | 9% | Invention |
| B8 | 10% | Invention |
| B9 | 14% | Invention |
| B10 | 45% | Comparison |
| B11 | 50% | Comparison |
| B12 | 48% | Comparison |
| B13 | 8% | Invention |
| B14 | 10% | Invention |
| B15 | 14% | Invention |
| B16 | 18% | Invention |
| B17 | 10% | Invention |
| B18 | 9% | Invention |
| B19 | 12% | Invention |
| B20 | 17% | Invention |
| B21 | 10% | Invention |
| B22 | 12% | Invention |
| B23 | 16% | Invention |
| B24 | 20% | Invention |

The sharpness of these samples was measured in the following manner.

Measurement of Sharpness (MTF)

The MTF was measured by a combination of the above-mentioned HR-4 screen and the processing with an automatic processor. The measurement was made using an aperture of 30 μm×500 μm, and evaluation was carried out at a portion having an optical density of 1.0, using an MTF value at a spatial frequency of 1.0 cycle/mm.

The evaluation revealed that less crossover light approximately resulted in larger MTF values.

EXAMPLE 2

The following components were added to the emulsion layer and intermediate layer-1 prepared in Example 1, followed by coating to prepare a photographic material.

Preparation of Auxiliary Developing Agent Layer

Gelatin, auxiliary developing agent ETA-1 (methanol solution) and auxiliary developing agent ETA-2 (fine solid grain dispersion) were each applied so as to give an amount coated of $1\times10^{-2}$ mol per mol of silver halide. This layer was used as intermediate layer-1 of Example 1 so as to give an amount of gelatin coated of 0.5 g/m$^2$.

ETA-1

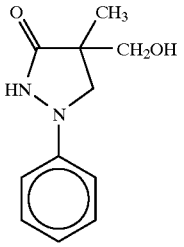

ETA-2

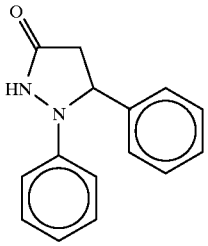

Couplers for color generation and reducing agents for color generation were dissolved in 73 cc of ethyl acetate and 52 g of solvent Solv-1 as shown in Table 8, and the resulting solution was emulsified in 420 cc of a 12% aqueous solution of gelatin containing 10% sodium dodecylbenzenesulfonate and citric acid. Thus, emulsions as shown in Table 8 were prepared. Each of theses emulsions was added to the emulsion layer.

Solv-1

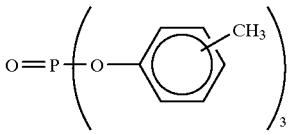

TABLE 8

| Emulsion | Coupler for Color Generation and Amount Coated per Mol of Aq | Reducing Agent and Amount Coated per Mol of Aq |
|---|---|---|
| A-1 | B-1: $0.9\times10^{-1}$ mol | C-1: $5\times10^{-1}$ mol |
| | B-2: $0.9\times10^{-1}$ mol | |
| | B-3: $1.8\times10^{-1}$ mol | |
| | B-4: $1.8\times10^{-1}$ mol | |
| A-2 | B-2: $1.8\times10^{-1}$ mol | C-2: $5\times10^{-1}$ mol |
| | B-6: $1.8\times10^{-1}$ mol | |
| | B-7: $1.8\times10^{-1}$ mol | |
| A-3 | B-7: $1.8\times10^{-1}$ mol | C-3: $5\times10^{-1}$ mol |
| | B-5: $1.8\times10^{-1}$ mol | |
| | B-8: $1.8\times10^{-1}$ mol | |
| A-4 | B-7: $1.8\times10^{-1}$ mol | C-4: $2.5\times10^{-1}$ mol |
| | B-5: $1.8\times10^{-1}$ mol | C-5: $2.5\times10^{-1}$ mol |
| | B-8: $1.8\times10^{-1}$ mol | |

B-1

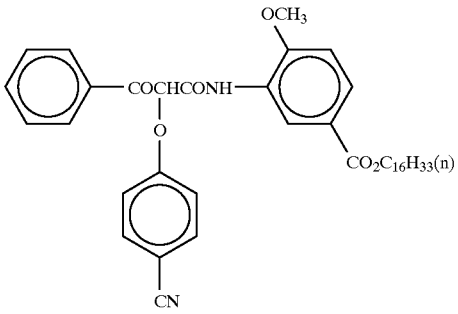

-continued
B-2
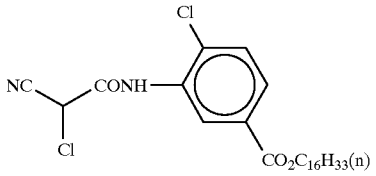
B-3
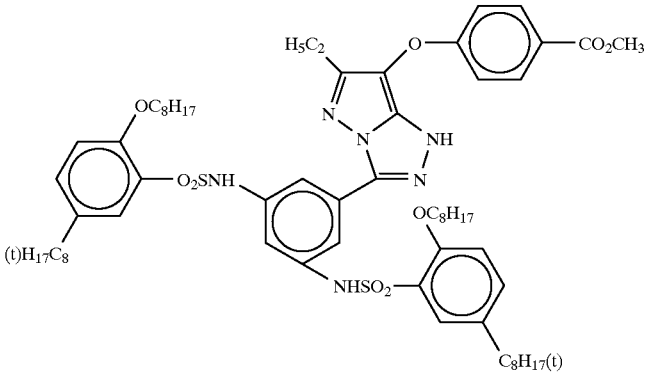
B-4
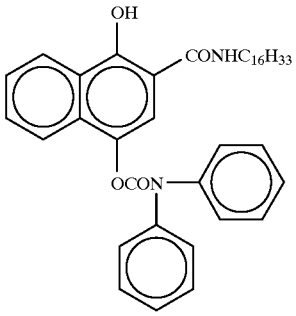
B-5
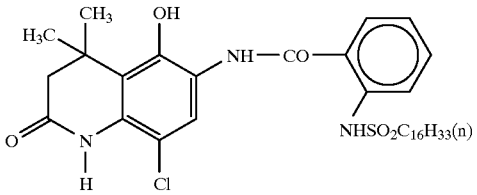
B-6
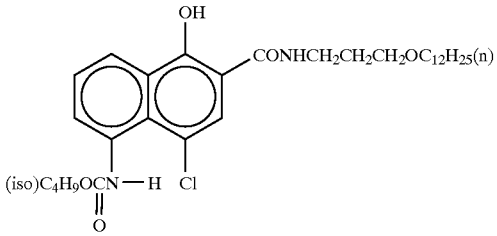

-continued
B-7
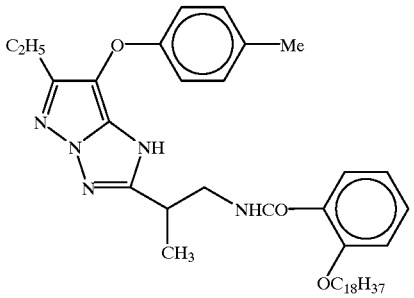
B-8
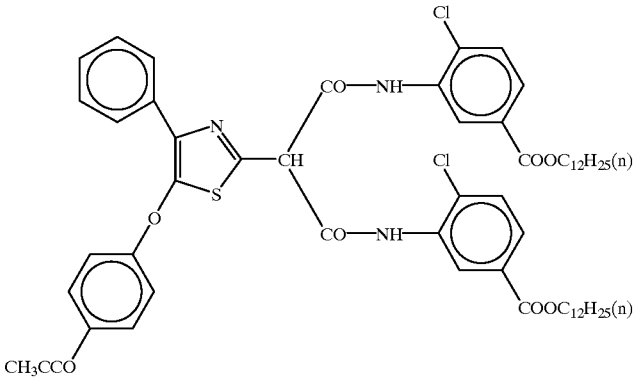
C-1
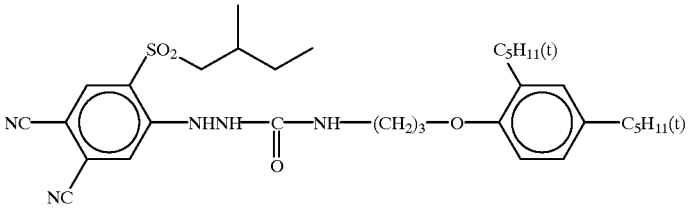
C-2
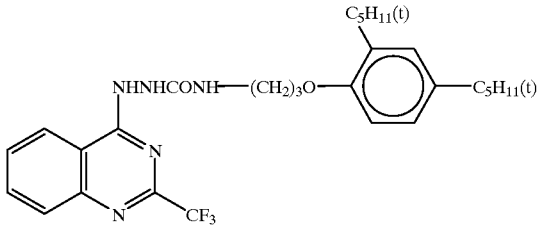
C-3
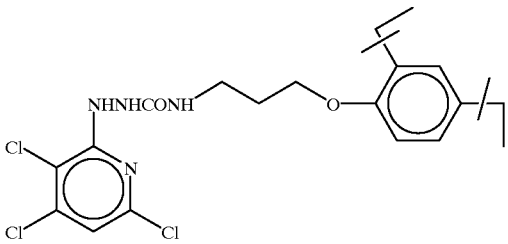

-continued

C-4

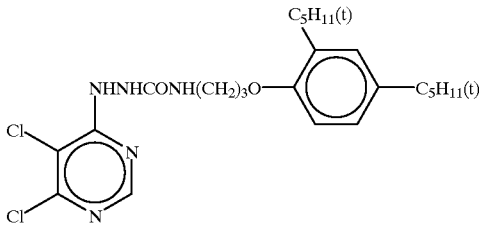

C-5

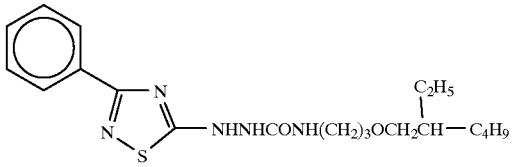

Preparation of Photographic Materials

A biaxially oriented polyethylene terephthalate support having a thickness of 175 μm was coated on the both surfaces with a combination of the above-mentioned auxiliary developing agent layer, emulsion layer and surface protective layer by the co-extrusion process. The amount of silver coated per one surface was 0.80 g/m$^2$. Thus, samples were prepared.

Evaluation of Photographic Characteristics

Each sample was brought into close contact with an HR-4 and an HG-M screen manufactured by Fuji Photo and Film Co., Ltd. and an UV rapid screen manufactured by E. I. du Pont de Nemours and Company, respectively, on both sides thereof, and exposed to X-rays for a period of 0.05 second from the both sides to conduct X-ray sensitometory.

The exposure was adjusted by changing the distance between an X-ray tube and a cassette. After exposure, the photographic material was processed with an automatic processor by use of the following developing solution and fixing solution.

Processing

Automatic Processor: A CEPROS-30 automatic processor manufactured by Fuji Photo and Film Co., Ltd. was converted to provide a rinsing tank between the fixing tank and the washing tank.

Developing Solution

| | Tank Solution | Replenisher |
|---|---|---|
| Water | 800 ml | 800 ml |
| Tripotassium Phosphate | 30 g | 39 g |
| 5-Nitrobenzotriazole | 0.1 g | 0.25 g |
| Disodium-N,N-bis(sulfonate-ethyl)hydroxylamine | 3.3 g | 6.6 g |
| Potassium Chloride | 10 g | — |
| Hydrbxyethylidene-1,1-diphosphonic Acid (30% solution) | 4 ml | 4 ml |
| Water to make | 1 liter | |
| pH | 12.0 | 12.0 |

Fixing Solution (Tank solution is the same as replenisher)

| | Replenisher |
|---|---|
| Ammonium Thiosulfate (70 wt/vol %) | 3000 ml |
| Disodium Ethylenediaminetetraacetate Dihydrate | 0.45 g |

-continued

| | |
|---|---|
| Sodium Sulfite | 225 g |
| Boric Acid | 60 g |
| 1-(N,N-Diethylamino)ethyl-5-mercaptotetrazole | 15 g |
| Tartaric Acid | 48 g |
| Glacial Acetic Acid | 675 g |
| Sodium Hydroxide | 225 g |
| Sulfuric Acid (36 N) | 58.5 g |
| Aluminum Sulfate | 150 g |
| Water to make | 6000 ml |
| pH | 4.68 |
| Rinsing Solution | |
| $K_3CO_3$ | 30 g |
| Tetrabutylammonium Bromide | 8 g |
| Acetic Acid | 6.8 g |
| Water to make | 1 liter |
| pH | 10.00 |

The washing tank was filled with service water.

Three polyethylene bottles were prepared each of which was filled with 0.4 g of perlite having an average particle size of 100 μm and an average pore size of 3 μm carrying Actinomyces as a scale inhibitor. An opening of each bottle was covered with a 300-mesh nylon cloth through which water and bacteria can pass. Two of them were sunk to the bottom of the washing tank, and one of them was sunk to the bottom of a stock tank (capacity: 0.2 liter) for washing water.

Processing Speed and Processing Temperature:

| | | |
|---|---|---|
| Development | 40° C. | 10 seconds |
| Fixing | 30° C. | 7.7 seconds |
| Rinsing | 17° C. | 5.0 seconds |
| Washing | 17° C. | 5.0 seconds |
| Squeeze | | 3.3 seconds |
| Drying | 58° C. | 9.0 seconds |
| Total | | 40 seconds |

Replenishment Rate

| | |
|---|---|
| Developing Solution | 8 ml/10 × 12 inches |
| Fixing Solution | 8 ml/10 × 12 inches |

The photographic materials of the present invention showed good results in evaluation of sensitometory.

EXAMPLE 3

Emulsions were prepared in the same manner as with Example 2 with the exception that solvent Solv-1 was replaced by Solv-2 for solving the couplers for color generation and the reducing agents for color generation, and coated samples were prepared in the same manner as with Example 2. The resulting samples were evaluated and processed in the same manner as with Example 2 with the exception that the rinsing step was excluded. As a result, the samples of the present invention showed good photographic characteristics.

Solv-2

$O{=}P{-}(O{-}C_6H_{13})_3$

EXAMPLE 4

Some of the samples evaluated in Example 1 were selected, and the ratio of the amount of the-dyes (dispersions) contained in the photographic materials after processing to the amount thereof before processing was determined. Results are shown in Table 9.

The determination was conducted by liquid chromatography, and for decolorized samples, the remaining rate was measured, using decolorized dyes as preparations.

TABLE 9

| Sample | Remaining Rate of Crossover Cut Dye |
|---|---|
| A1 | 0% |
| A2 | 1% |
| A3 | 1% |
| B1 | 95% |
| B2 | 98% |
| B3 | 96% |
| B5 | 98% |
| B7 | 95% |
| B14 | 98% |
| B17 | 90% |
| B23 | 93% |

What is claimed is:

1. An image formation method using a silver halide photographic material comprising a transparent film support having provided on each side thereof at least one light-sensitive silver halide emulsion layer and a dye-fixed layer for absorbing crossover light disposed nearer to the support than said at least one light-sensitive silver halide emulsion layer, wherein a dye used in said dye-fixed layer is a compound which is decolorized in development processing, wherein the total development processing time (dry to dry) is 80 seconds or less, and 10% or more of the decolorization dye remains in the photographic material after development, wherein the crossover light is 30% or less, and the amount of waste liquid of a developing solution and/or a fixing solution is 300 ml or less per $m^2$ of the photographic material, wherein said at least one light-sensitive silver halide emulsion layer contains a silver halide grain emulsion having (i) a silver chloride content of 20% or more and (ii) an average aspect ratio of 2 or more, wherein said dye is a compound which is decolorized by light irradiation of 100,000 lux·min. or less.

2. An image formation method as claimed in claim 1, wherein an X-ray image is formed in combination with a phosphor having a luminescence maximum at 500 nm to 700 nm.

3. An image formation method as claimed in claim 1, wherein a developing agent in a developing solution used for the development processing is ascorbic acid and/or a derivative thereof.

* * * * *